US010138019B2

(12) United States Patent
Clark et al.

(10) Patent No.: US 10,138,019 B2
(45) Date of Patent: Nov. 27, 2018

(54) BAKERY TRAY ASSEMBLY

(71) Applicant: Rehrig Pacific Company, Los Angeles, CA (US)

(72) Inventors: Suzanne Whitfield Clark, Santa Monica, CA (US); Jon P. Hassell, Atlanta, GA (US); Dane Gin Mun Kalinowski, Irvine, CA (US); Glenn Rindfleisch, Naples, FL (US)

(73) Assignee: REHRIG PACIFIC COMPANY, Los Angeles, CA (US)

( * ) Notice: Subject to any disclaimer, the term of this patent is extended or adjusted under 35 U.S.C. 154(b) by 206 days.

(21) Appl. No.: 14/796,882

(22) Filed: Jul. 10, 2015

(65) Prior Publication Data

US 2016/0007737 A1 Jan. 14, 2016

Related U.S. Application Data

(60) Provisional application No. 62/149,878, filed on Apr. 20, 2015, provisional application No. 62/061,678, filed on Oct. 8, 2014, provisional application No. 62/023,896, filed on Jul. 12, 2014.

(51) Int. Cl.

| | |
|---|---|
| ***B65D 1/34*** | (2006.01) |
| ***B65D 1/40*** | (2006.01) |
| ***B65D 21/02*** | (2006.01) |
| ***B65D 25/30*** | (2006.01) |
| ***B65D 25/00*** | (2006.01) |
| *B65D 85/36* | (2006.01) |

(52) U.S. Cl.

CPC ..... *B65D 21/0215* (2013.01); *B65D 1/40* (2013.01); *B65D 25/00* (2013.01); *B65D 25/30* (2013.01); *B65D 1/34* (2013.01); *B65D 85/36* (2013.01)

(58) Field of Classification Search

CPC ..... B65D 21/0209; B65D 21/0212; B65D 21/0213; B65D 21/0215; B65D 21/0216; B65D 21/0235

USPC ..... 211/126.2, 126.4, 126.12; 206/509, 503, 206/504, 505, 506, 507, 508, 510, 511, 206/512; 220/607, 608

See application file for complete search history.

(56) References Cited

U.S. PATENT DOCUMENTS

| | | | | |
|---|---|---|---|---|
| 3,283,943 | A * | 11/1966 | Cargnelutti | B65D 21/0212 206/509 |
| 3,366,273 | A * | 1/1968 | Crocella | B65D 21/0213 206/509 |
| 3,572,577 | A * | 3/1971 | Dorfman | B65D 5/0015 206/509 |
| 4,342,393 | A * | 8/1982 | Box | B65D 21/0202 119/437 |
| 5,896,992 | A * | 4/1999 | McGrath | B65D 21/045 206/505 |
| 6,202,847 | B1 * | 3/2001 | Hardy | B65D 21/0213 206/509 |
| 6,260,706 | B1 * | 7/2001 | Koefelda | B65D 21/046 206/505 |
| 6,338,316 | B1 | 1/2002 | Weaver | |
| 6,398,054 | B1 | 6/2002 | Overholt et al. | |

(Continued)

*Primary Examiner* — Joshua E Rodden

(74) *Attorney, Agent, or Firm* — Carlson, Gaskey & Olds, P.C.

(57) ABSTRACT

A top cap for a tray includes an upper surface for supporting goods and a lower surface including an attachment portion for locating the top cap relative to an upper portion of the tray.

14 Claims, 31 Drawing Sheets

(56) References Cited

U.S. PATENT DOCUMENTS

| | | | | |
|---|---|---|---|---|
| 7,686,167 | B1 * | 3/2010 | Stahl | B65D 21/045 206/507 |
| 8,720,687 | B2 * | 5/2014 | Hassell | B65D 21/046 206/505 |
| 9,061,693 | B2 * | 6/2015 | Hassell | B62B 3/16 |
| 9,540,140 | B2 * | 1/2017 | Hassell | B65D 21/0215 |
| 2003/0205495 | A1 * | 11/2003 | Verna | B65D 1/38 206/509 |
| 2007/0175790 | A1 * | 8/2007 | Fernandez | B65D 21/045 206/503 |
| 2010/0000900 | A1 * | 1/2010 | Hassell | B65D 21/046 206/509 |
| 2012/0193260 | A1 * | 8/2012 | Baltz | B65D 21/0212 206/503 |
| 2012/0241349 | A1 | 9/2012 | Koefelda et al. | |
| 2014/0262910 | A1 * | 9/2014 | Sommer | B65D 21/0216 206/509 |

* cited by examiner

BAKERY TRAY ASSEMBLY

CROSS-REFERENCE TO RELATED APPLICATIONS

The application claims priority to U.S. Provisional Application No. 62/023,869 which was filed on Jul. 12, 2014, U.S. Provisional Application No. 62/061,678 which was filed on Oct. 8, 2014, and U.S. Provisional Application No. 62/149,878 which was filed on Apr. 20, 2015.

BACKGROUND

This disclosure relates to a container, and more particularly to a bakery tray having adjustable stacking heights and a device for stacking thereon.

A common tray used in bakeries has two end walls for stacking and two shorter side walls for product visibility and to allow nesting. These trays typically nest by rotating alternate trays 90 degrees. They are easy to blind stack (i.e. stack above your head where it is difficult to see any locating features). However, the requirement to nest the trays in a 90 degree rotation makes the footprint of the nested trays larger than a single tray and results in a low nest ratio, which is limited by the height of the side walls.

In some of the known trays, one of the side walls is shorter than the other, so that it is low enough for removing product even when the trays are stacked. This is commonly called a dropside version. This lower sidewall may also be called a window. When the trays are stacked, it is advantageous for the dropsides to align on the same side of the stack, so that product can be accessed from any of the trays from the same side. However, the dropside is weaker and deflects considerably more than the opposite side.

Sometimes it is desirable for the trays to be stacked at a selected one of two selected heights, in order to minimize the stacking height to that required by the product in the trays at the time. This is usually accomplished by trays that stack at different heights when they are rotated 180 degrees relative to one another. However, this means that the dropsides cannot be on the same side of the stack when the trays are arranged in alternating 180 degree orientations in order to achieve one of the stack heights. Additionally, having two stack heights limits the ability to blind stack and the features to create this often cause the external dimensions of the tray to be larger. The larger tray size reduces the amount of full goods that can be shipped.

SUMMARY

A top cap for a tray includes an upper surface for supporting goods and a lower surface including an attachment portion for locating the top cap relative to an upper portion of the tray.

A tray includes a base and at least one wall extending upward from the base having an inner wall portion spaced from an outer wall portion by an upper wall portion. A notch extends through the inner wall portion, the upper wall portion, and the upper wall portion.

A tray includes a base having a curvature with a first pair of walls and a second pair of walls extending upward from the base.

DETAILED DESCRIPTION

Figure 1:
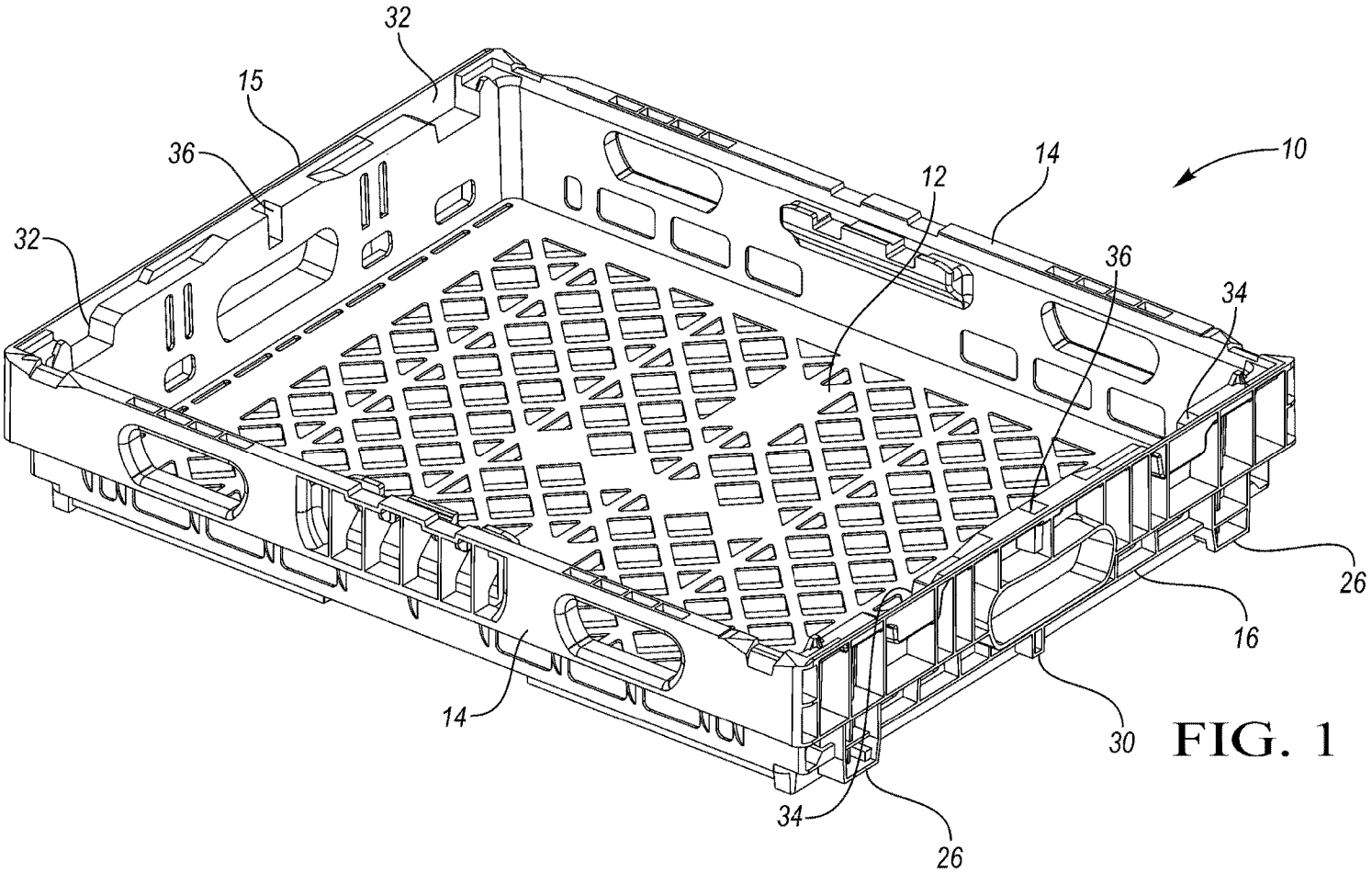
FIG. 1 PRIOR ART
FIG. 1 illustrates an example tray according to a first embodiment.

A bakery tray 10 is shown in FIG. 1. The bakery tray 10 generally includes a base 12, front and rear walls 14 extending upwardly from front and rear edges of the base 12 of the tray 10, and side walls 15, 16 extending upwardly from side edges of the base 12 of the tray 10. The side walls 15, 16 include handles formed therein. Each of the front and rear walls 14 includes a pair of handles formed therein.

Each of the side walls 15, 16 further include a pair of stacking feet 26 and a center projection 30 projecting downwardly. An upper edge of one side wall 15 includes a pair of stacking recesses 32 and a center recess 36 aligned with its corresponding center projection 30. The upper edge of the other side wall 16 includes a pair of stacking recesses 34 and another center recess 36 aligned with its corresponding center projection 30. The stacking feet 26 and the stacking recesses 32, 34 are spaced in such a way as to provide high and low stacking heights when the stacked trays 10 are rotated 180 degrees relative to one another, according to any of several known configurations.

For example, on the side wall 16, the feet 26 are spaced further outward (toward front and rear walls 14), while on the side wall 15, the feet 26 (not visible) are spaced further inward (away from front and rear walls 14). The recesses 32 are spaced further outward, while the recesses 34 are further inward. This is one way of providing stacking at a high stack position in one orientation and at a low stack position in another (180 degree) orientation.

The tray 10 of FIG. 1 is prior art but together with top caps, such as those disclosed herein, form an inventive combination.

Figure 2:
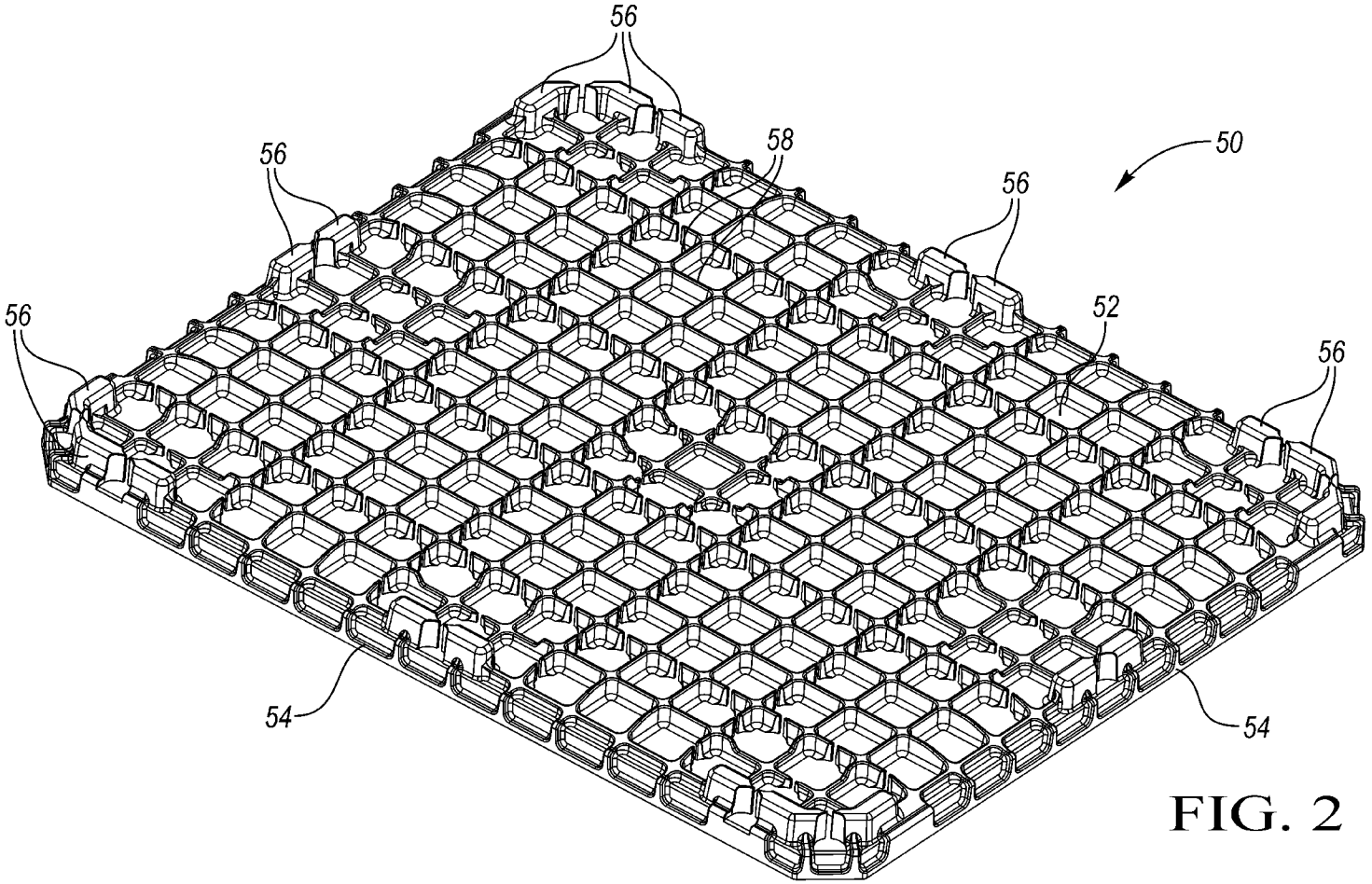
FIG. 2 illustrates a top perspective view of a top cap according to a first embodiment.

FIG. 2 shows a top cap 50 according to a first embodiment. The top cap 50 is formed from a flat sheet of plastic into the shape shown, such as by thermoforming, vacuum forming, etc. Although the example shown is a single sheet, a twin-sheet thermoformed version is also contemplated. The top cap 50 as formed includes an upper panel portion 52 having a lip 54 extending downward from a periphery thereof. A plurality of alignment pylons 56 project upward from the periphery of the upper panel portion 52, such as at each of the corners and from the middle of the front and rear edges and side edges.

Figure 3:
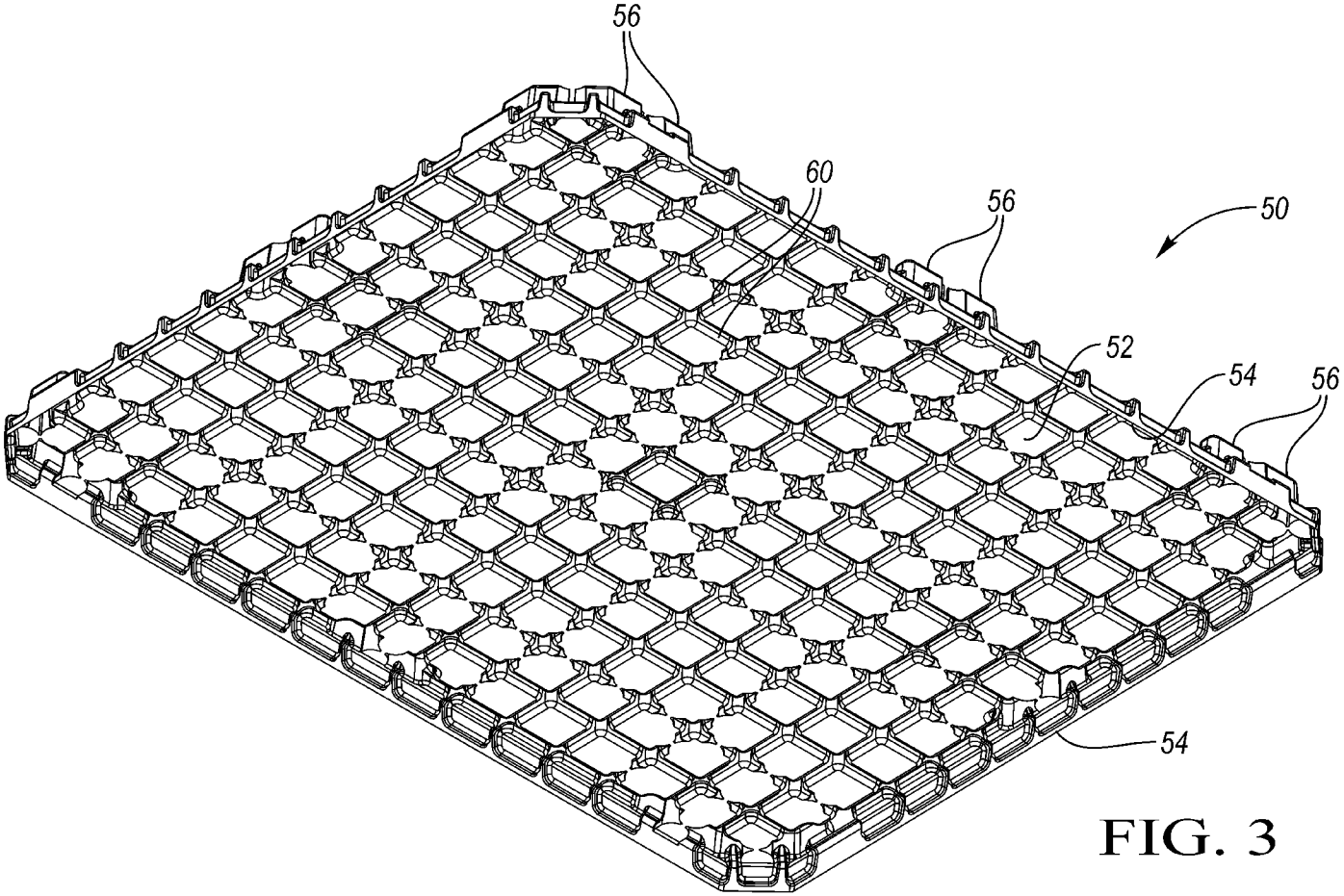
FIG. 3 illustrates a bottom perspective view of the top cap of FIG. 2.

A plurality of reinforcement ridges 58 project upward relative to the upper panel portion 52. Each reinforcement ridge 58 includes a pair of spaced-apart walls formed by the plastic sheet. As shown in FIG. 3 (bottom view), a recess or elongated channel 60 is formed on the bottom surface of the top cap 50, corresponding to the reinforcement ridges 58 (FIG. 2) on top. As shown, the alignment pylons 56 are also hollow and open downwardly.

Figure 4:
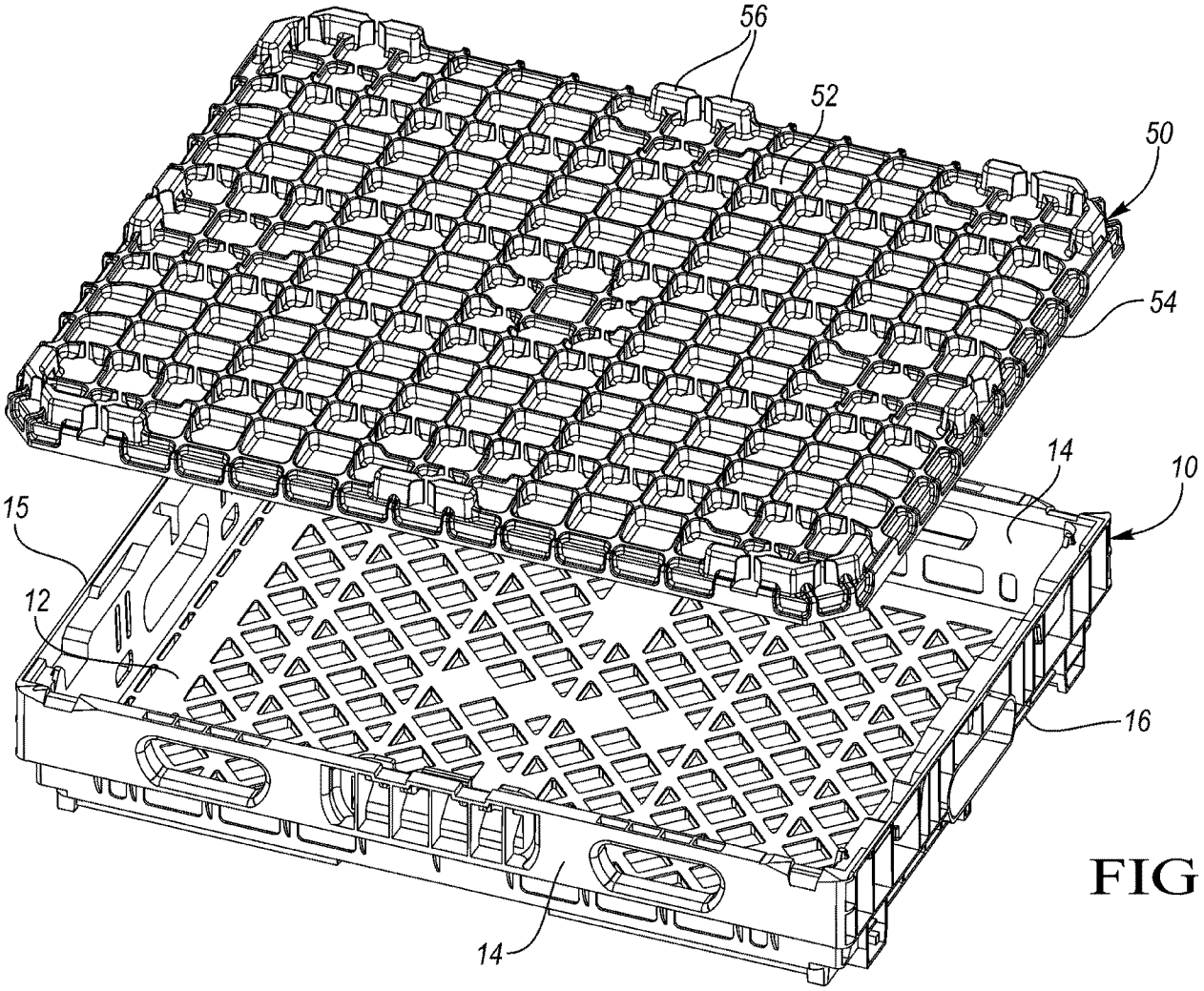
FIG. 4 illustrates a perspective view of the top cap of FIG. 2 positioned relative to the tray of FIG. 1.
Figure 5:
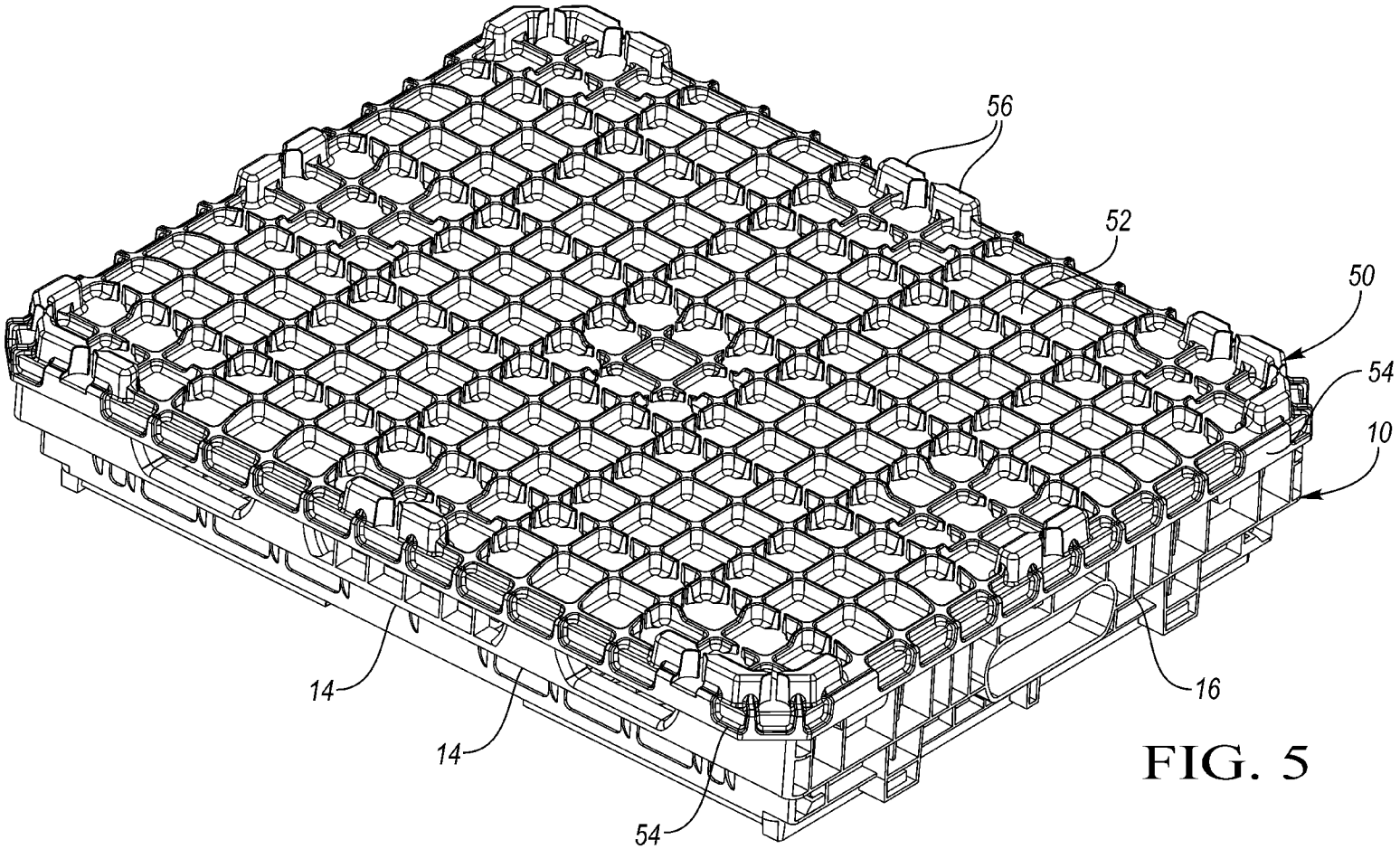
FIG. 5 illustrates a perspective view of the top cap of FIG. 2 located on the tray of FIG. 1.

As shown in FIGS. 4 and 5, the top cap 50 is sized and configured to be received on the tray 10. The upper edges of the walls 14, 15, 16 of the tray 10 are received behind the lip 54 of the top cap 50. This secures the top cap 50 stably on the tray 10.

Figure 6:
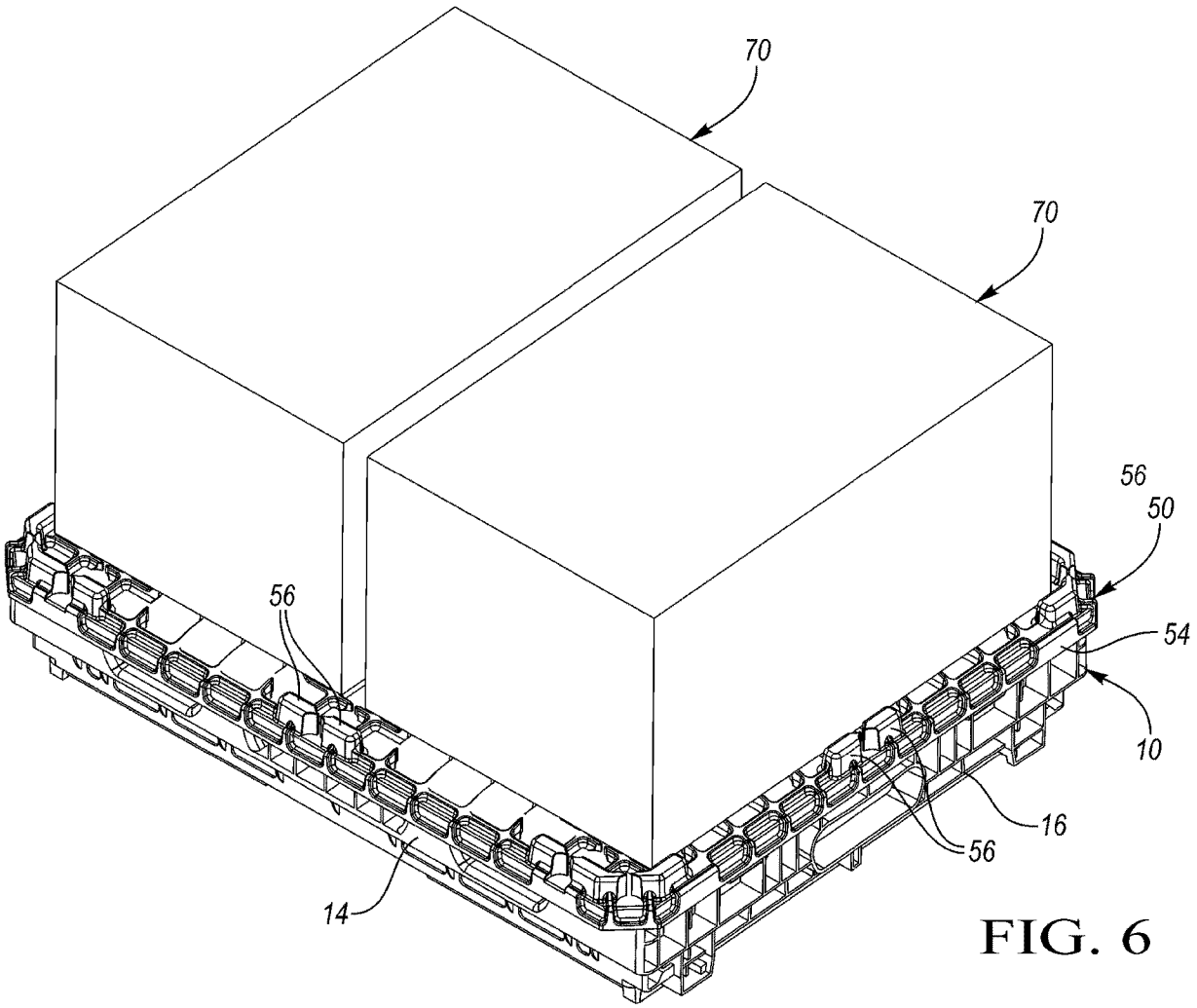
FIG. 6 illustrates a perspective view of items located on the top cap of FIG. 2 and the tray of FIG. 1.

As shown in FIG. 6, with the top cap 50 on the tray 10, items 70 (such as boxes) can be placed on top of the top cap 50 without damaging any contents of the tray 10. The alignment pylons 56 assist in retaining the items 70 on the top cap 50 during transport on the tray 10. The top cap 50 allows the tray 10 to palletize with non-compatible products. In comparison, without the top cap 50, the tray 10 can only stack with itself or on top of a flat even surface that is equal to or greater than the length and width of the tray 10.

Figure 7:
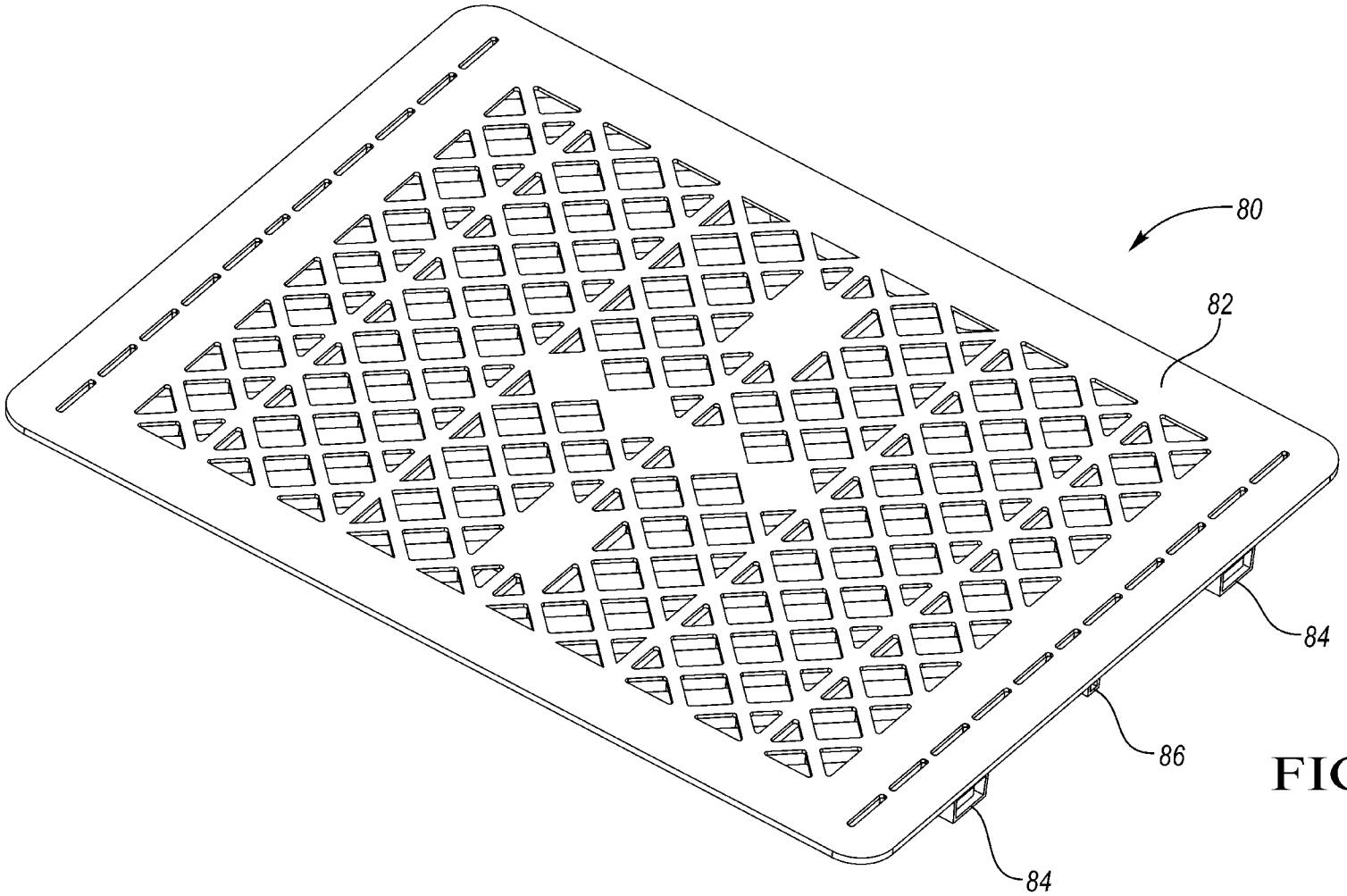
FIG. 7 illustrates a top perspective view of a top cap according to a second embodiment.
Figure 10:
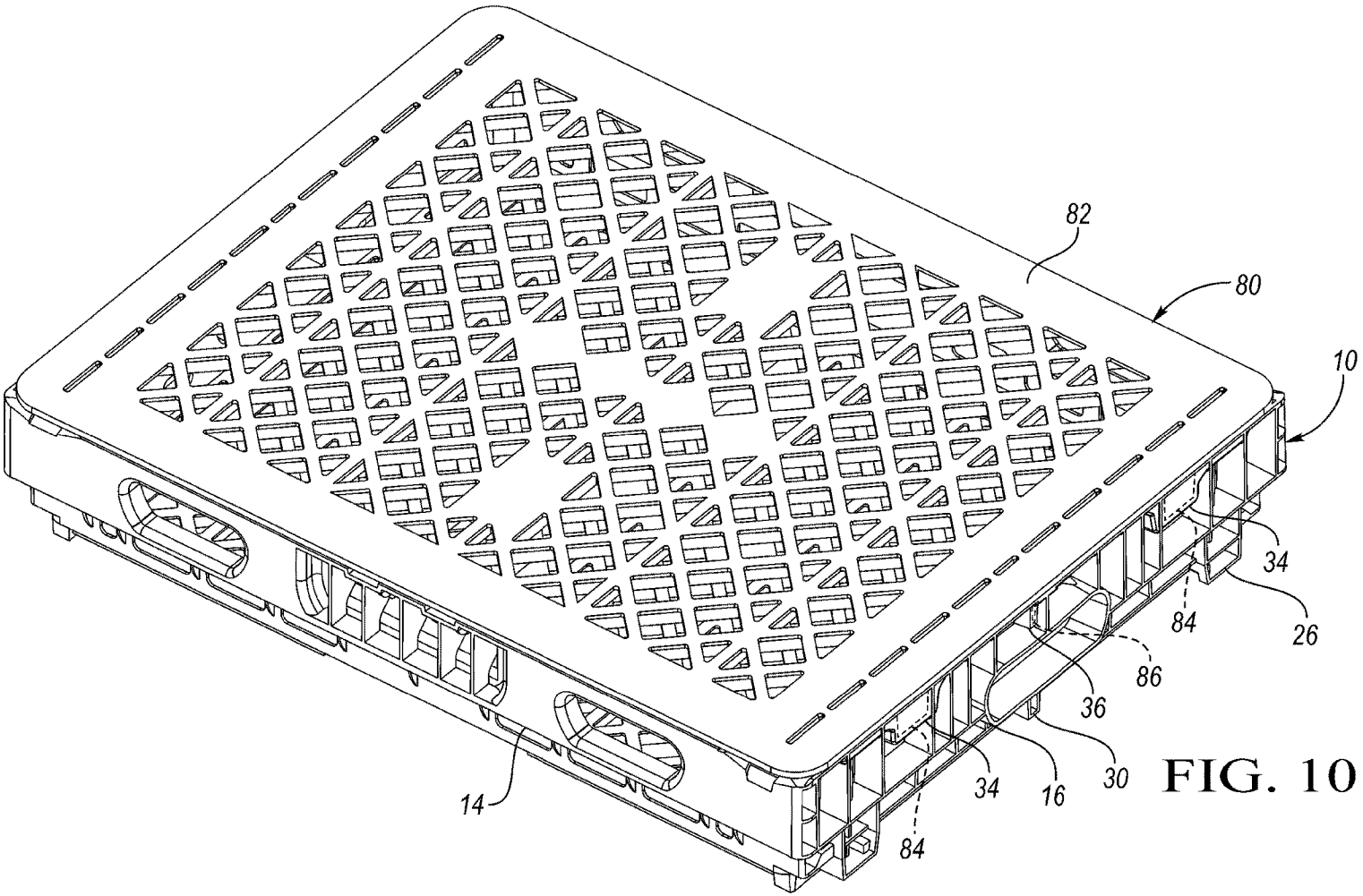
FIG. 10 illustrates a perspective view of the top cap of FIG. 7 located on the tray of FIG. 1.

FIG. 7 shows a top cap 80 according to a second embodiment. The top cap 80 is injection molded and fits within the footprint of the tray 10, as shown in FIG. 10. The top cap 80 includes a base 82 having a plurality of feet 84. The feet 84 should match or correspond to the feet 26 of the tray 10 in size and configuration. The top cap 80 may also include a center projection 86 corresponding to the center projection 30.

Figure 8:
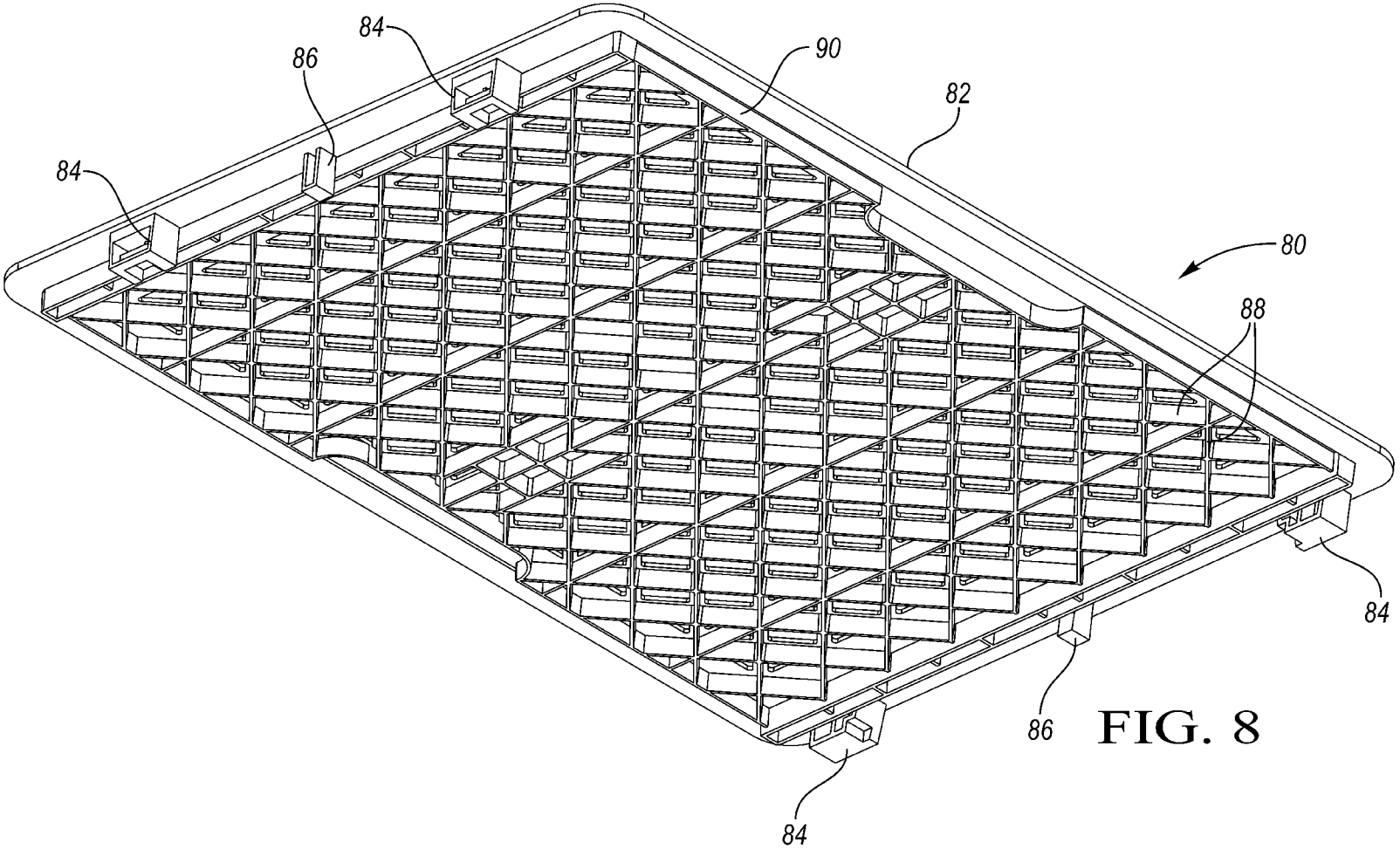
FIG. 8 illustrates a bottom perspective view of the top cap of FIG. 7.

FIG. 8 is a bottom view of the top cap 80 of FIG. 7. A plurality of ribs 88 project downward from the base 82 for reinforcement, including a peripheral inner lip 90 projecting downward, but spaced inward from the periphery of the base 82. Again, the spacing of the feet 84 and the presence of the central projection 86 would depend on the configuration of the tray 10.

Figure 9:
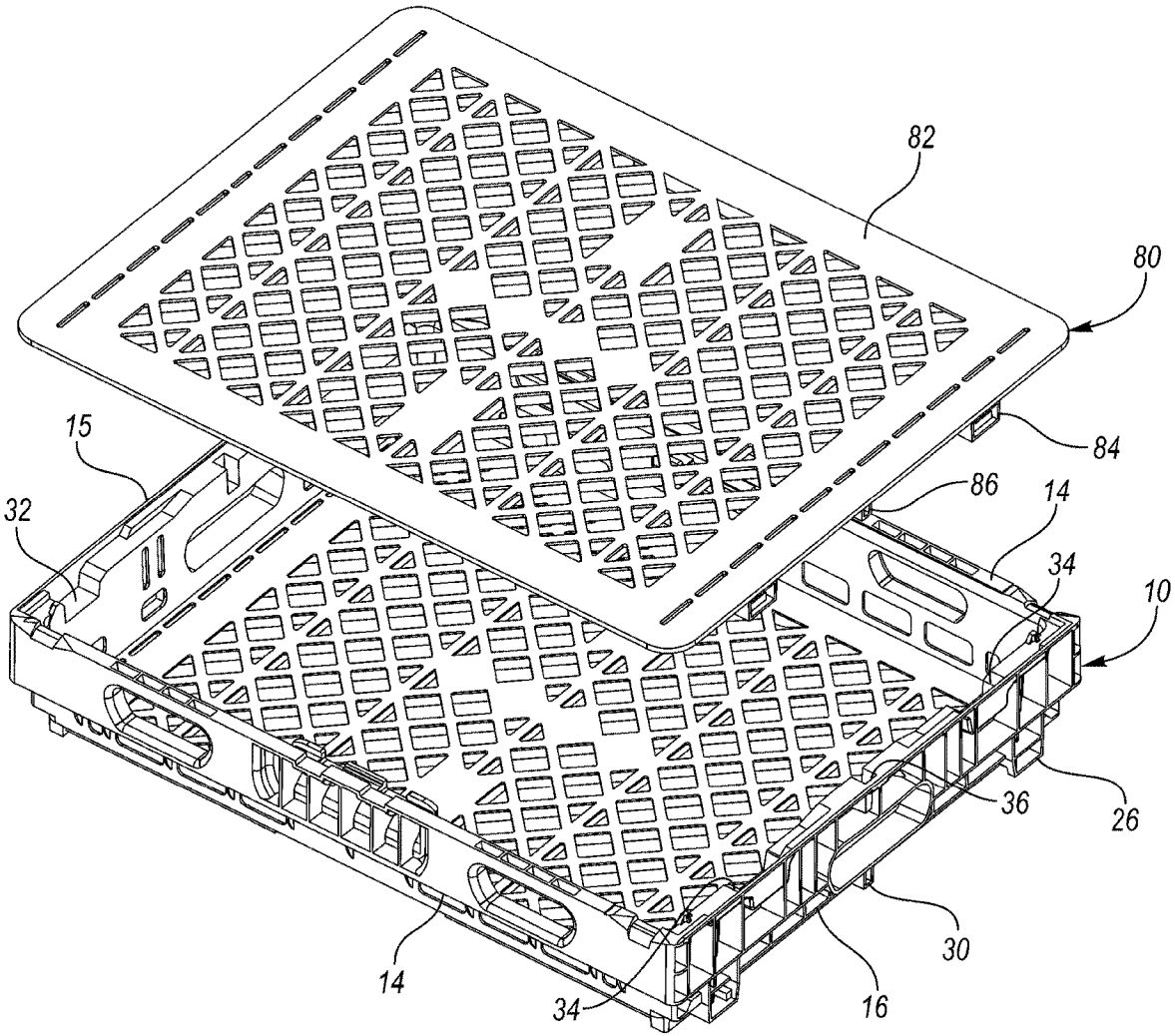
FIG. 9 illustrates a perspective view of the top cap of FIG. 7 positioned relative to the tray of FIG. 1.

As shown in FIGS. 9 and 10, the top cap 80 can be placed on the tray 10, with the feet 84 received in the recesses 32, 34 of the tray 10 and the center projections 86 received in the center recesses 36. The portion of the base 82 outward of the inner lip 90 contacts the upper edges of the walls 14, 15, 16 of the tray 10. The inner lip 90 is received just inside the walls 14, 15, 16 of the tray 10 to help keep the top cap 80 in position on the tray 10.

Figure 11:
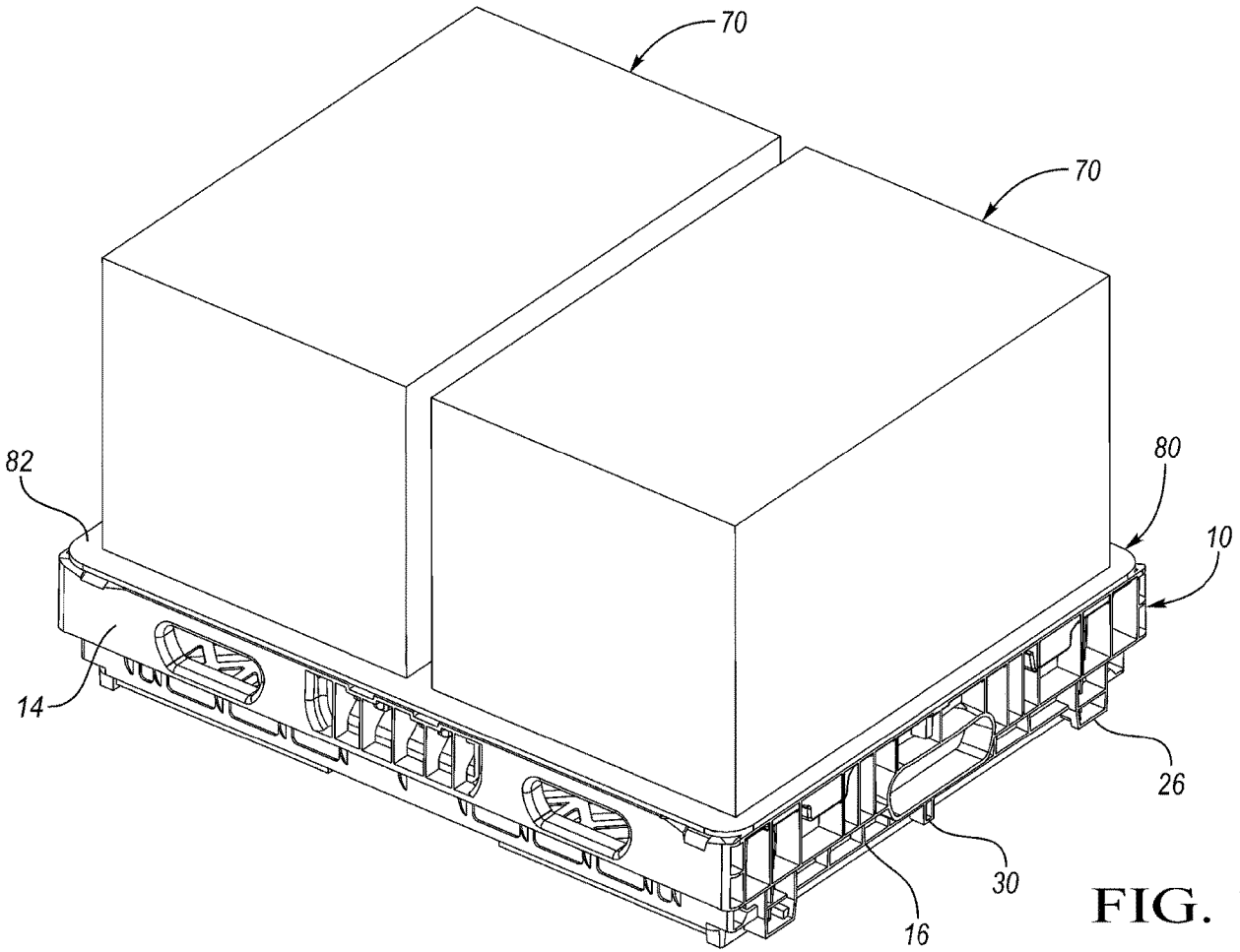
FIG. 11 illustrates a perspective view of items located on the top cap of FIG. 7 and the tray of FIG. 1.

As shown in FIG. 11, items 70 can be placed on the top cap 80 on the tray 10 for transport without damaging the contents of the tray 10. The top cap 80 allows the tray 10 to palletize with non-compatible products. In comparison, without the top cap 80, the tray 10 can only stack with itself or on top of a flat even surface that is equal to or greater than the length and width of the tray 10.

Figure 12:
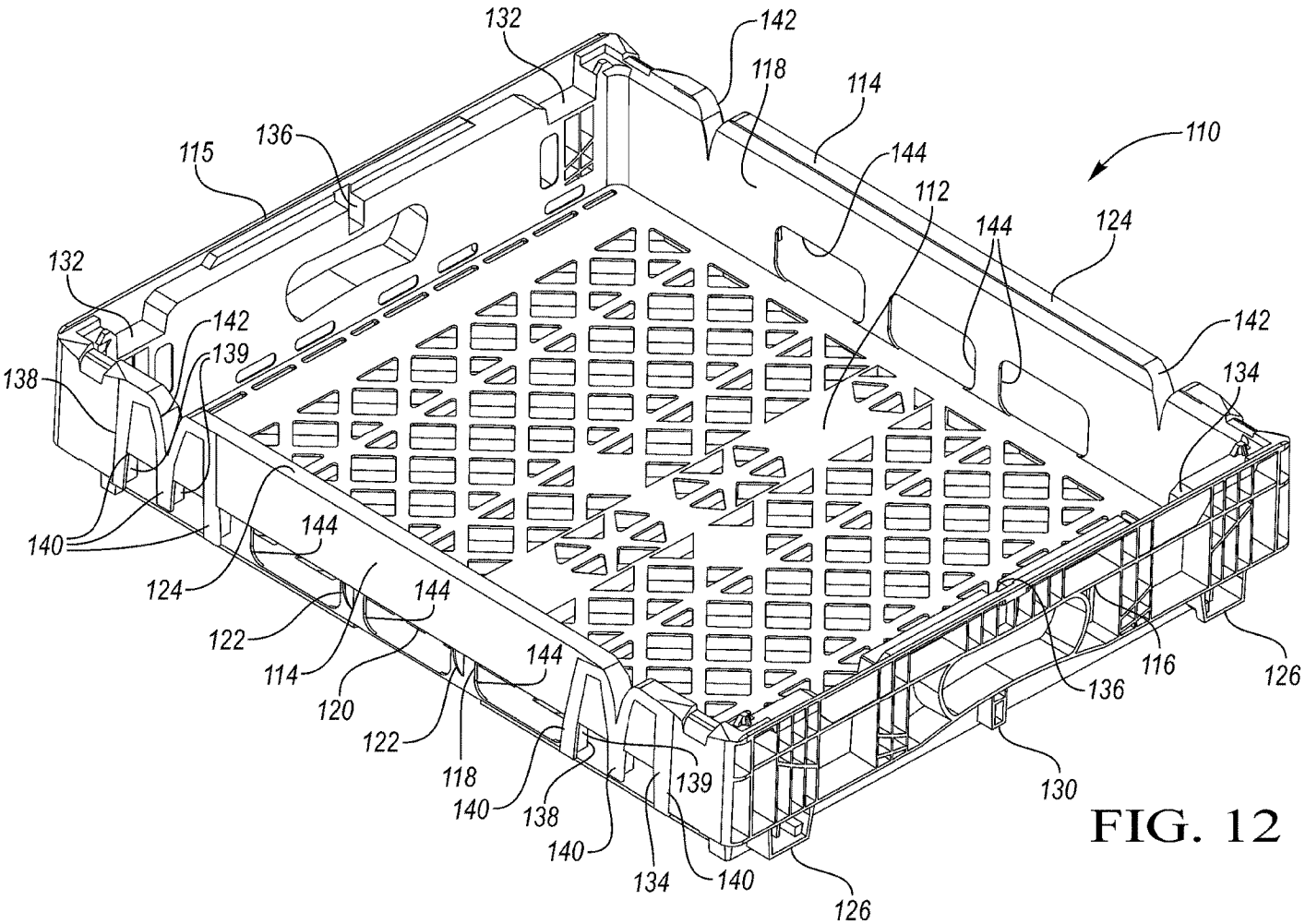
FIG. 12 illustrates a perspective view of a tray according to a second embodiment.

FIG. 12 illustrates a bakery tray 110 according to a second embodiment. The bakery tray 110 is similar to the bakery tray 10 except where described below or shown in the Figures. The bakery tray 110 generally includes a base 112, front and rear walls 114 extending upwardly from front and rear edges of the tray 110, and side walls 115, 116 extending upwardly from side edges of the base 112. The side walls 115, 116 include handles formed therein.

Each of the front and rear walls 114 includes an inner wall portion 118 and an outer wall portion 120 (or lip). The outer wall portion 120 is spaced outward of the inner wall portion 118 and extends downward from an upper wall portion 124 but not all the way to the bottom of the tray 110. In the illustrated non-limiting embodiment, the outer wall portion 120 extends about halfway from the upper edge of the tray 110 toward the bottom of the tray 110.

A plurality of windows 144 are formed through the inner wall portion 118 below the outer wall portion 120. The windows 144 may align with visual indicators on the bags of products (e.g. buns—not shown) to be placed in the tray 110, so that the visual indicators indicate what kind of product (e.g. what kind of buns) are in the tray 110. A plurality of ribs 122 connect the inner wall portion 118 to the outer wall portion 120 between the windows 144.

The outer wall portions 120 of the front and rear walls 114 also include one or more (two shown) logos 138 formed as part of the outer wall portions 120. Each logo 138 includes generally vertical portions 140 or legs at the bottom. The logo 138 at least partially defines a notch 142 at the top of the logo 138. The vertical portions 140 may be joined to the inner wall portion 118 via perpendicular vertical ribs 139. The notches 142 help define the logo 138 and provide additional visibility into the tray 110. The notches 142 extend all the way through the walls 114 (inner wall portion 118, outer wall portion 120 and upper wall portion 124).

The logos 138 are molded integrally with the remainder of the tray 110 (of some suitable plastic material). The logos 138 may also be tip branded after the tray 110 is molded.

Each of the side walls 115, 116 further includes a pair of stacking feet 126 and a center projection 130 projecting downwardly. An upper edge of one side wall 115 includes a pair of stacking recesses 132 and a center recess 136 aligned with a corresponding center projection 130. The upper edge of the other side wall 116 includes a pair of stacking recesses 134 and another center recess 136 aligned with a corresponding center projection 130. The stacking feet 126 and stacking recesses 132, 134 are spaced in such a way as to provide different stacking heights when stacked trays are rotated 180 degrees relative to one another, according to any of several known configurations.

For example, on the side wall 116, the feet 126 are spaced further outward (toward front and rear walls 114), while on the side wall 115, the feet 126 (not visible) are spaced further inward (away from the front and rear walls 114). The recesses 132 are spaced further outward, while the recesses 134 are further inward. This is one way of providing stacking at a high stack position in one orientation and at a low stack position in another (180 degree) orientation.

Figure 13:
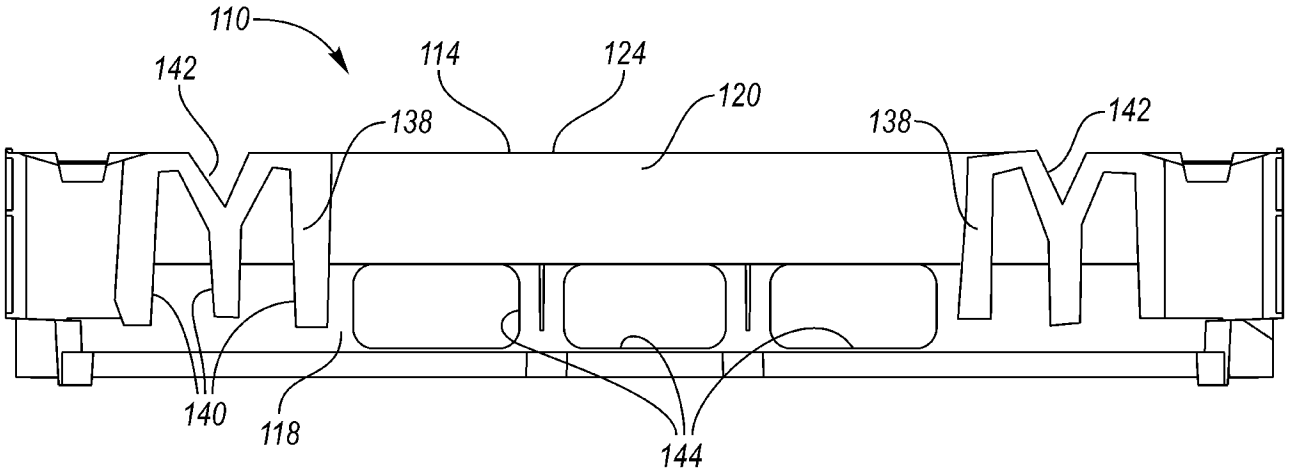
FIG. 13 illustrates a front view of the tray of FIG. 12.
Figure 14:
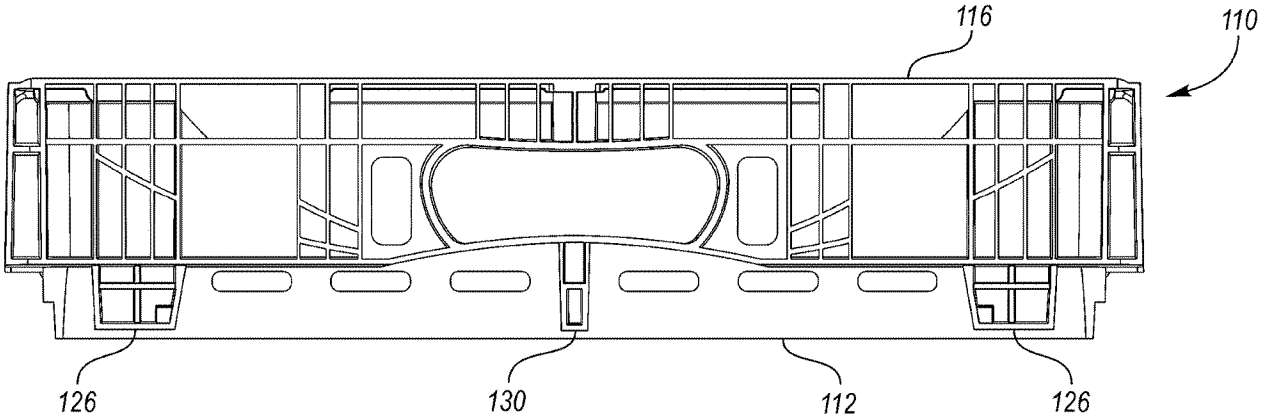
FIG. 14 illustrates a side view of the tray of FIG. 12.
Figure 15:
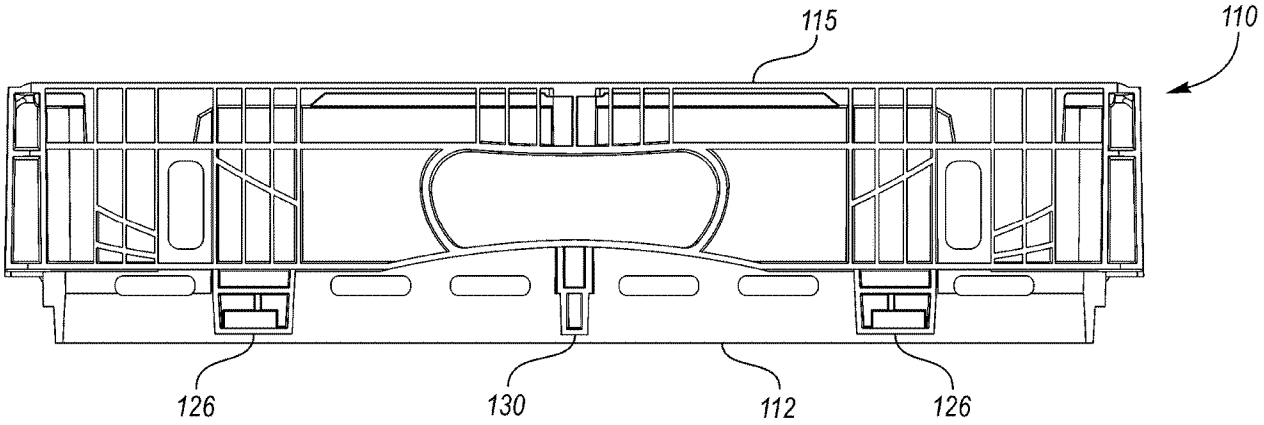
FIG. 15 illustrates another side view of the tray of FIG. 12.
Figure 17:
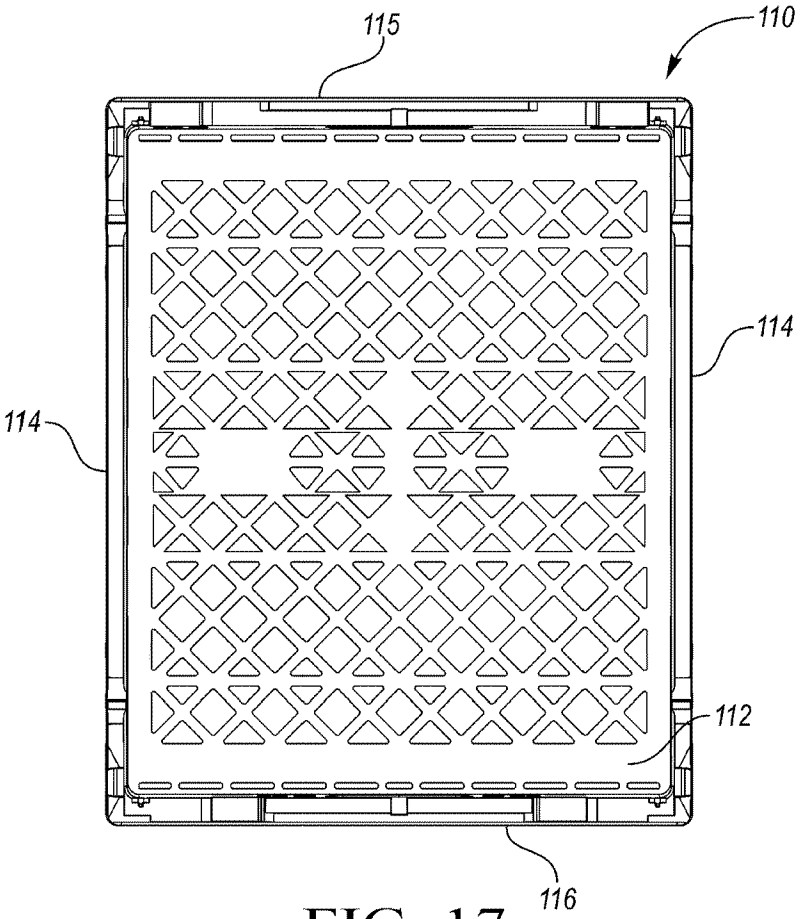
FIG. 17 illustrates a top view of the tray of FIG. 12.
Figure 16:
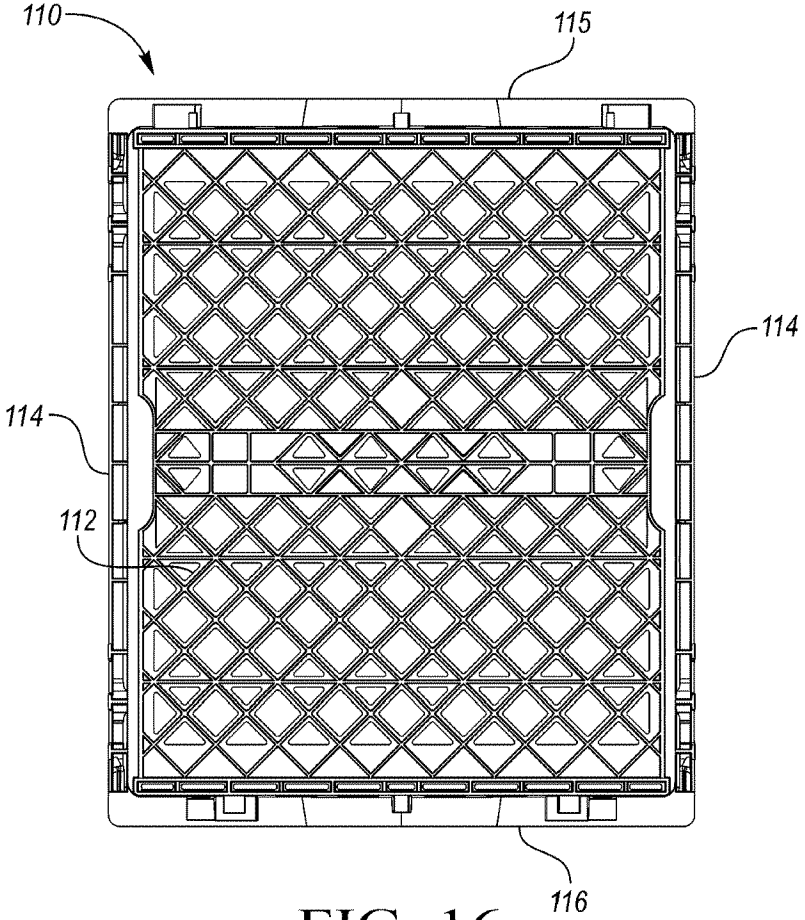
FIG. 16 illustrates a bottom view of the tray of FIG. 12.

FIG. 13 is a front view of the tray 10. FIGS. 14 and 15 are side views. FIGS. 16 and 17 are bottom and top views of the tray 10, respectively.

Figure 18:
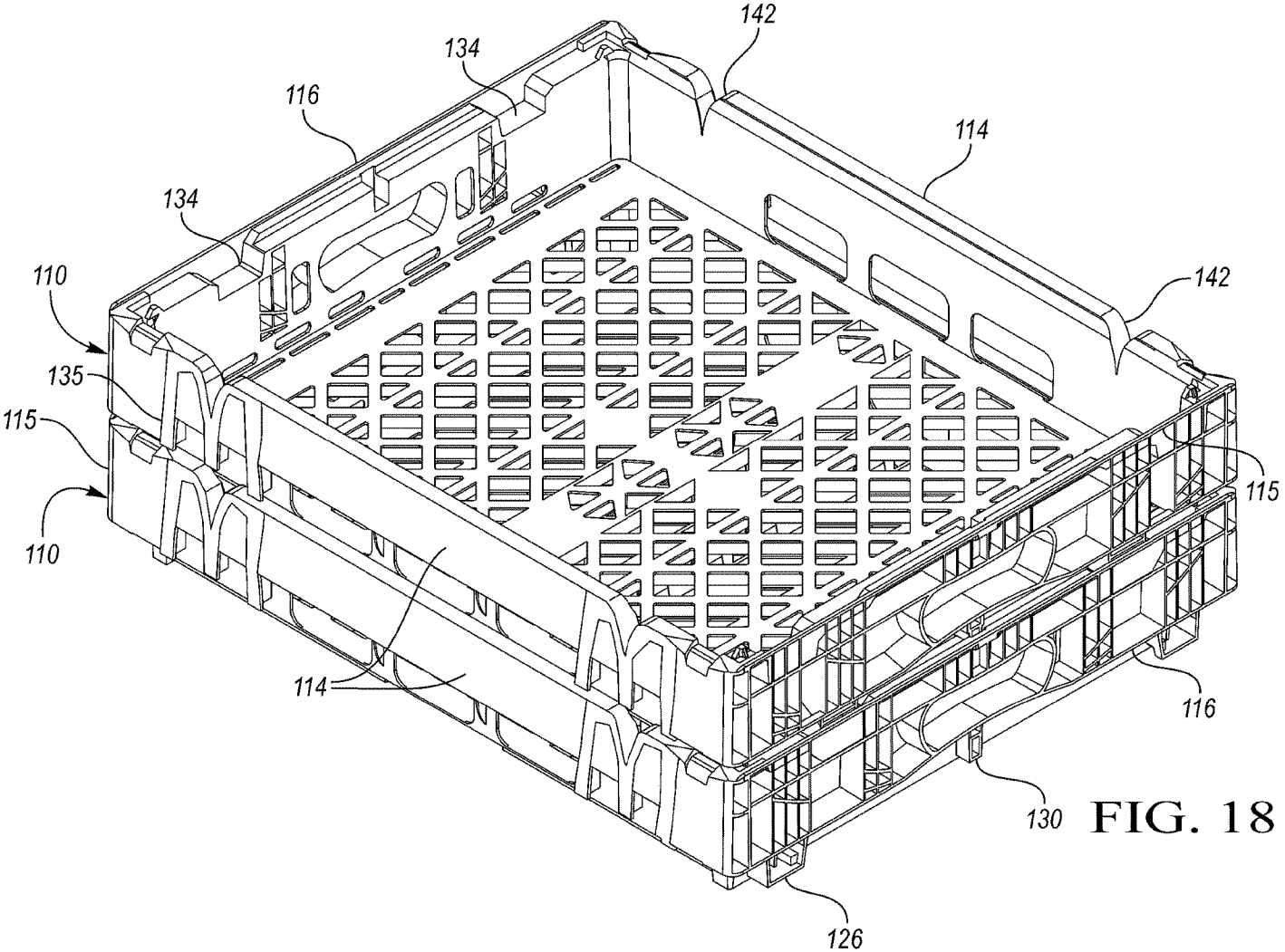
FIG. 18 illustrates a perspective view of the tray of FIG. 12 in a low stacked position on a similar tray.
Figure 19:
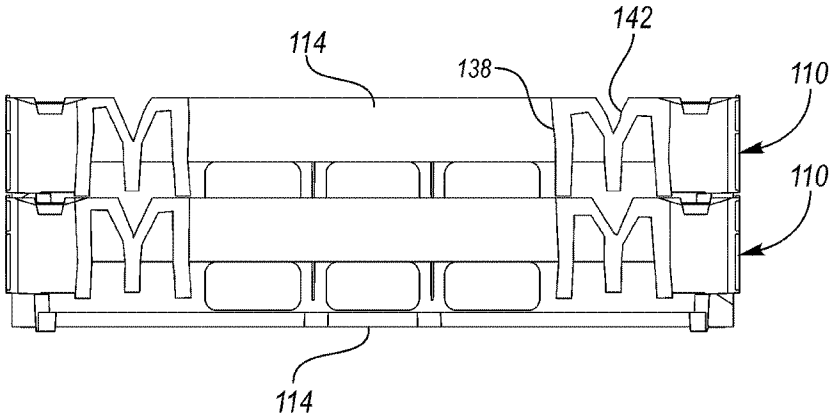
FIG. 19 illustrates a front view of the tray of FIG. 12 in the low stacked position on the similar tray.
Figure 21:
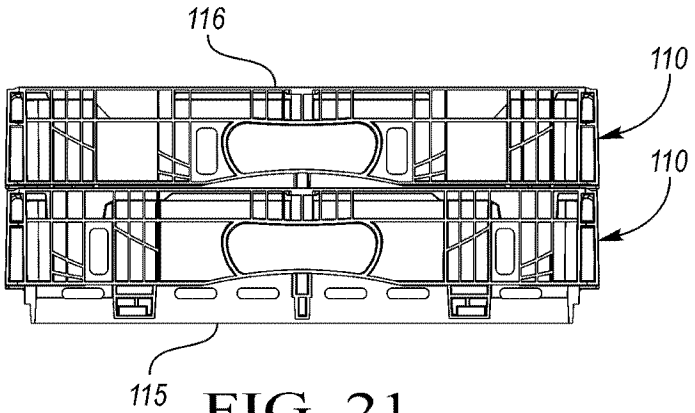
FIG. 21 illustrates another end view of the tray of FIG. 12 in the low stacked position on the similar tray.
Figure 20:
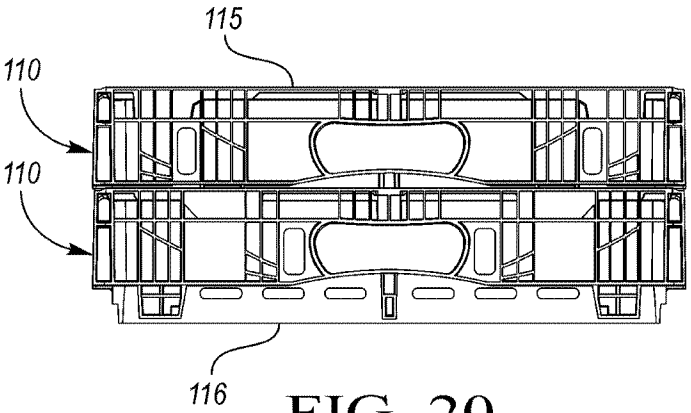
FIG. 20 illustrates an end view of the tray of FIG. 12 in the low stacked position on the similar tray.

FIG. 18 shows the tray 110 with an identical tray 110 stacked thereon with the tray 110 in the low stack position (i.e. the upper tray 110 rotated 180 degrees relative to the bottom tray 110). FIG. 19 is a front view of the trays 110 of FIG. 18. FIGS. 20 and 21 are side views of the trays 110 of FIG. 18.

Figure 22:
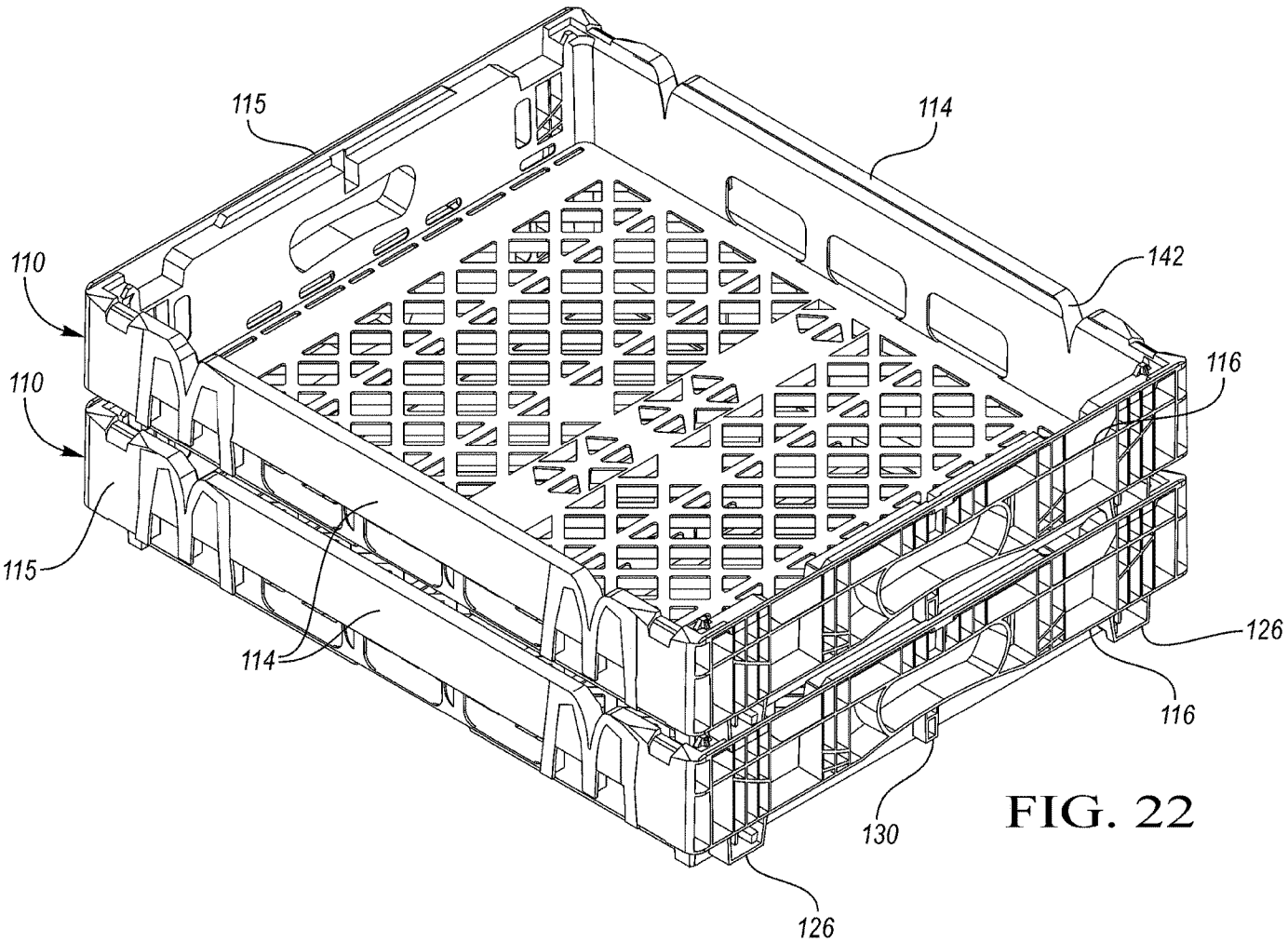
FIG. 22 illustrates a top perspective view of the tray of FIG. 12 in the high stacked position on the similar tray.
Figure 23:
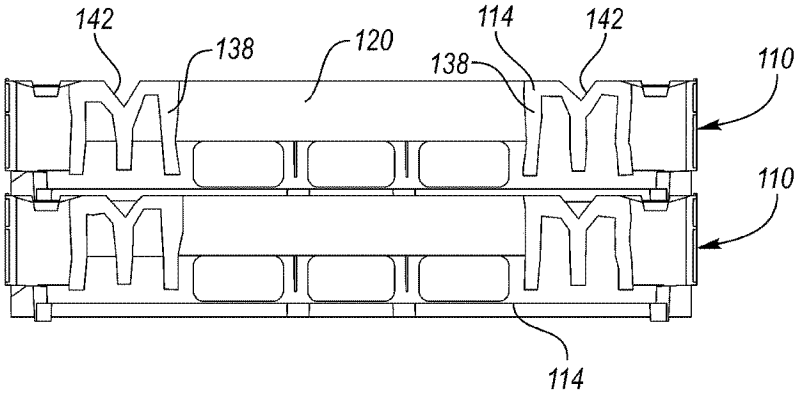
FIG. 23 illustrates a front view of the tray of FIG. 12 in the high stacked position on the similar tray.
Figure 25:
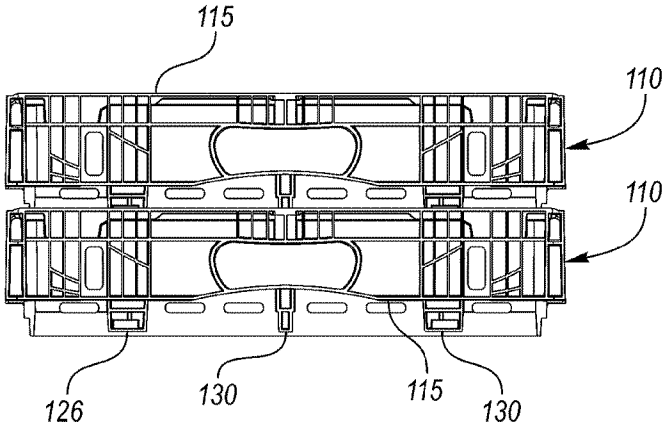
FIG. 25 illustrates another end view of the tray of FIG. 12 in the high stacked position on the similar tray.
Figure 24:
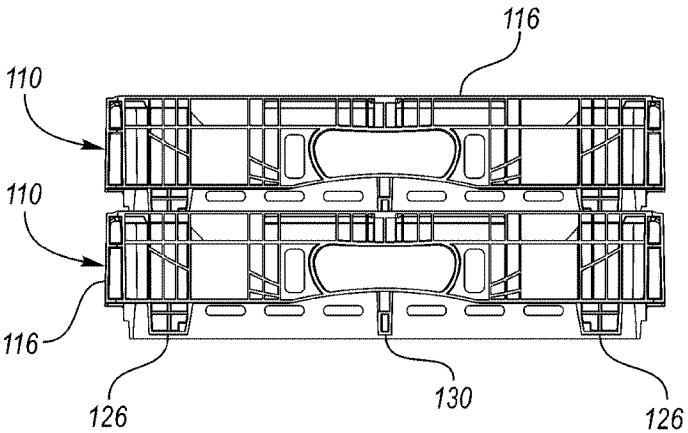
FIG. 24 illustrates an end view of the tray of FIG. 12 in the high stacked position on the similar tray.

FIG. 22 shows the tray 110 with an identical tray 110 stacked on the tray 110 in the high stack position (i.e. the upper tray 110 in rotational alignment relative to the bottom tray 110). FIG. 23 is a front view of the trays 110 of FIG. 22. FIGS. 24 and 25 are side views of the trays 110 of FIG. 22.

Figure 26:
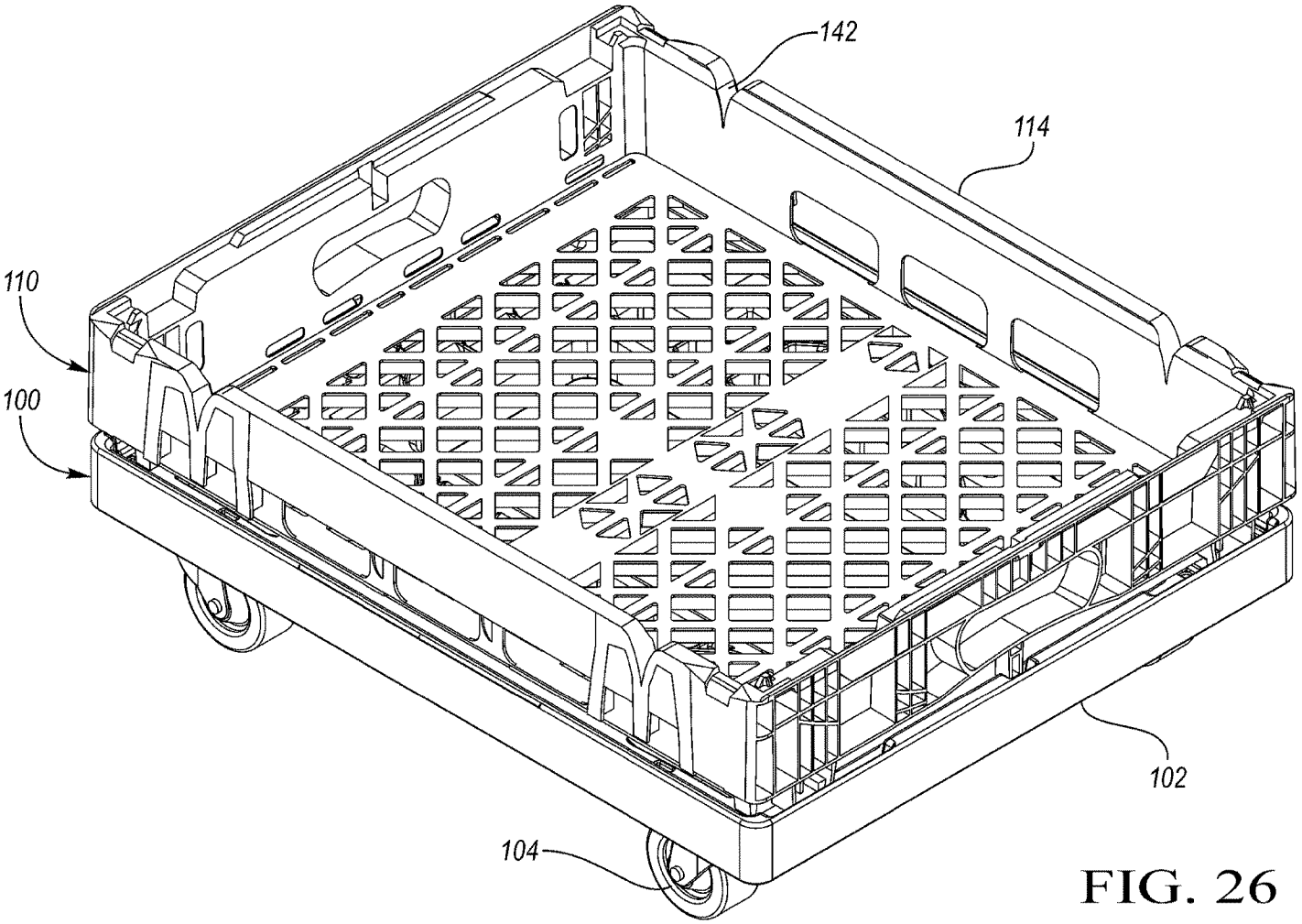
FIG. 26 illustrates the tray of FIG. 12 stacked on an example dolly.

As shown in FIG. 26, the tray 110 (or a stack of trays 110) can be moved about on a dolly 100 having a deck 102 and wheels or castors 104.

Figure 27:
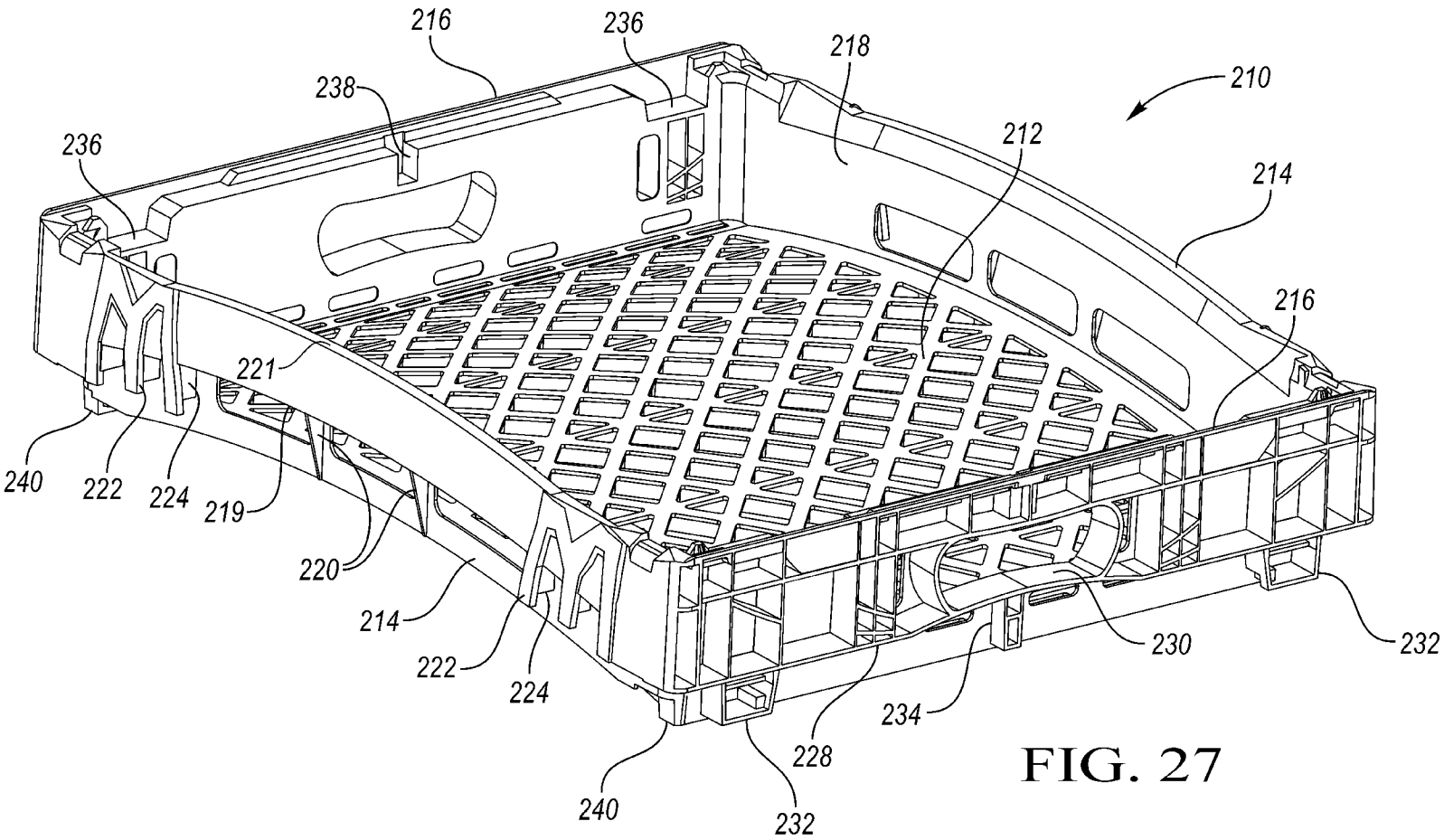
FIG. 27 illustrates a perspective view of a tray according to a third embodiment.

FIG. 27 illustrates a bakery tray 210 according to a third embodiment. The bakery tray 210 is similar to the bakery tray 10 except where described below or shown in the Figures. The bakery tray 210 generally includes a base 212, front and rear walls 214 extending upwardly from front and rear edges of the base 212, and side walls 216 extending upwardly from side edges of the base 212.

The base 212 is curved and in the illustrated non-limiting embodiment the base 212 is convex. The base 212 curves convexly with a single curve from one side wall 216 to the other side wall 216 with a peak in a middle portion of the base 212, in particular the center of the base 212 between the two side walls 216. In another non-limiting embodiment, the curvature could extend between the front and rear walls 214. Additionally, the curvature of the base 212 is continuous between the sidewalls 216. The front and rear walls 214 are curved with the base 212, such that each front and rear wall 214 has a peak at a middle portion between the two side walls 216.

Each of the front and rear walls 214 includes an inner wall portion 218 and an outer wall portion 219 (or lip). The outer wall portion 219 is spaced outward of the inner wall portion 218 and extends downward from an upper wall portion 221 but not all the way to the bottom of the tray 210. In the illustrated non-limiting embodiment, the outer wall portion 219 extends about halfway from the upper edge of the tray 210 toward the bottom of the tray 210. Gussets 220 connect the inner wall portion 218 to the outer wall portion 219 along the front and rear walls 214. Logos 222 may be molded as part of the outer wall portion 219 and are also connected by gussets 224 to the inner wall portion 218. The outer wall portion 219 provides larger surface area for branding in comparison to the small branding area of existing trays.

The side walls 216 include a plurality of ribs 228 projecting outward from a planar interior wall portion. The ribs 228 are spaced upward from the lower edge of the side walls 216. A pair of feet 232 and a center projection 234 project downward from the ribs 228 and outward from the lower portions of the side walls 216. The upper ends of the side walls 216 include pockets for receiving the feet 232 and center projection 234. One of the side walls 216 includes pockets 236 for receiving the feet 232 and a central pocket 238 for receiving the center projection 234 of an identical tray 210 stacked thereon. The side walls 216 include lower support portions 240 that contact the floor and are the lowest portions of the tray 210.

Figure 28:
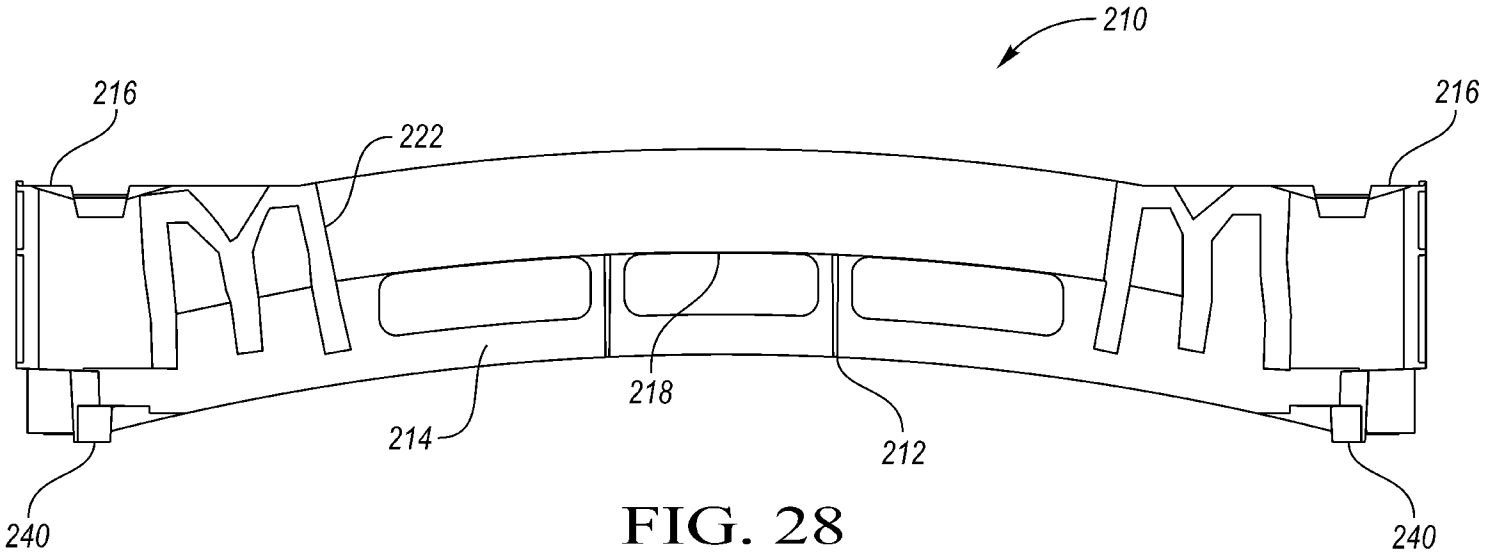
FIG. 28 illustrates a front view of the tray of FIG. 27.

As shown in FIG. 28, the base 212 and front wall 214 curve upward to a peak in the middle and are convex upward. Lower support portions 240 of the side walls 216 support the base 212 on the floor.

Figure 29:
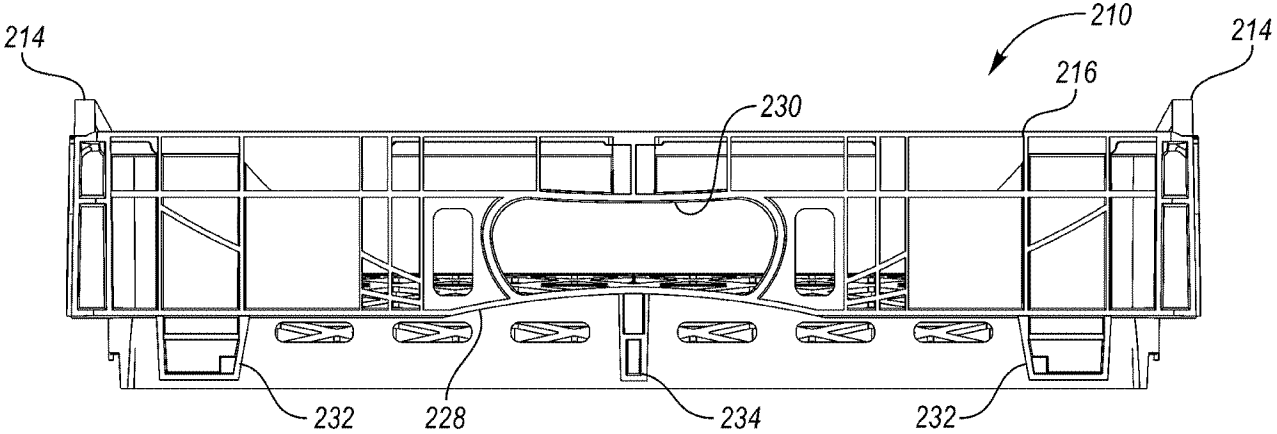
FIG. 29 illustrates a side view of the tray of FIG. 27.
Figure 30:
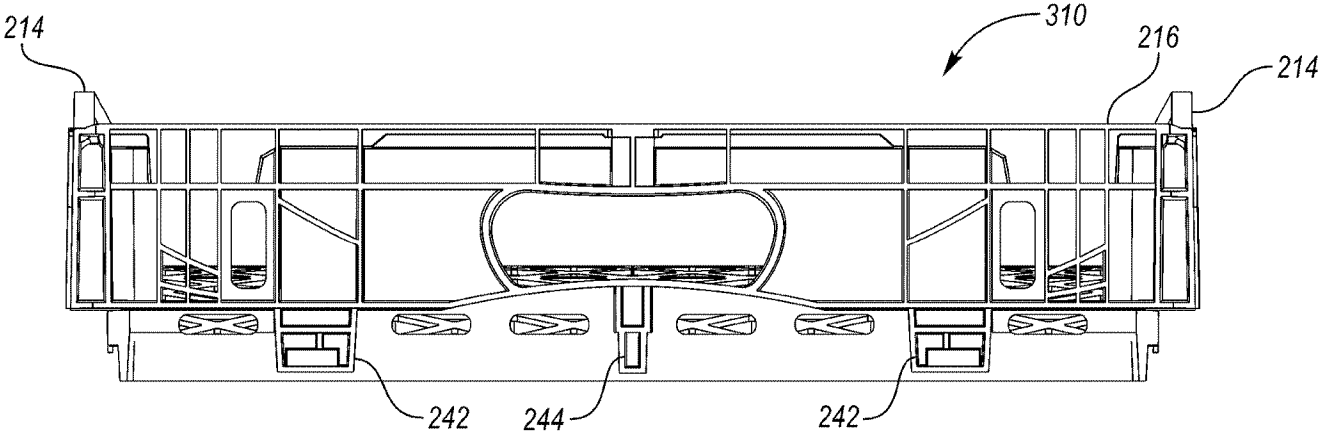
FIG. 30 illustrates another side view of the tray of FIG. 27.

Referring to FIGS. 29 and 30, the side walls 216 have feet 232, 242 that are spaced differently to provide different stacking heights in a known manner. In the example shown, the feet 232 are spaced closer to the front and rear walls 214 than the feet 242. Both center projections 234, 244 are in the center.

Figure 31:
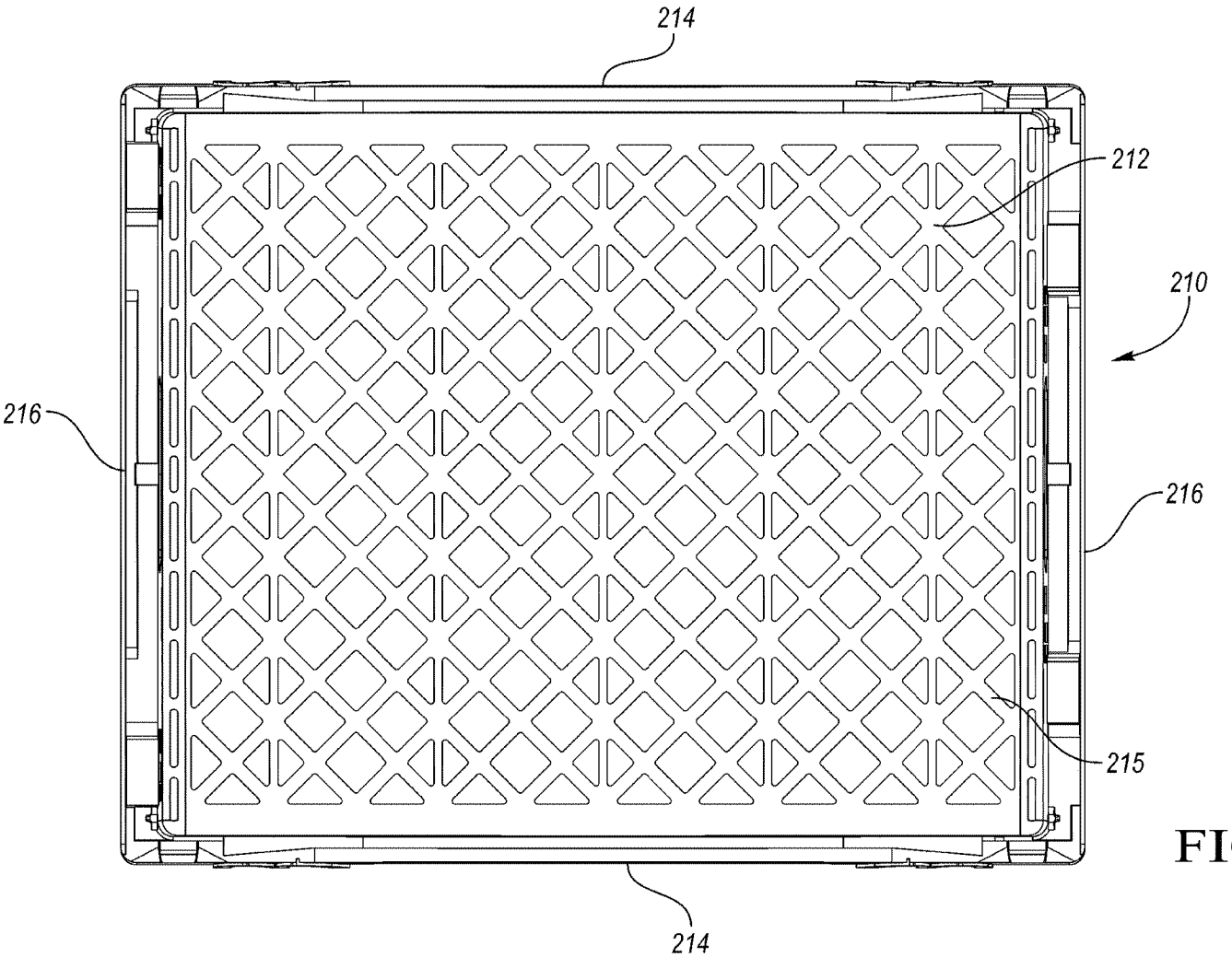
FIG. 31 illustrates a bottom view of the tray of FIG. 27.
Figure 32:
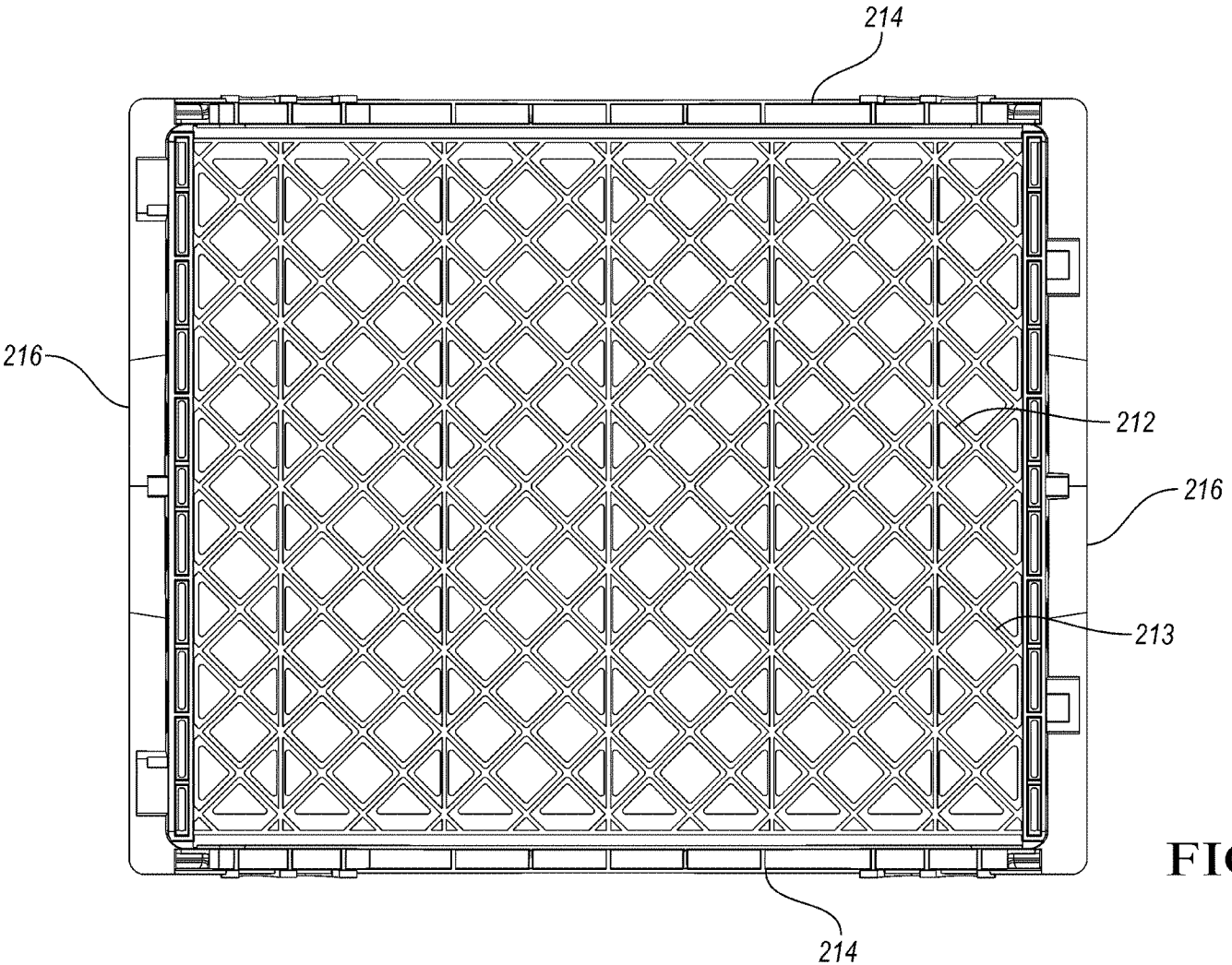
FIG. 32 illustrates a top view of the tray of FIG. 27.

FIG. 31 is a top view of the tray 210 showing a support surface 215. FIG. 32 is a bottom view of the tray 10 illustrating a plurality of ribs 213 that extend downward from the support surface 215 of the base 212 such that the base 212 forms a grid. In the illustrated non-limiting embodiment, the grid forms a diamond shaped pattern.

Figure 33:
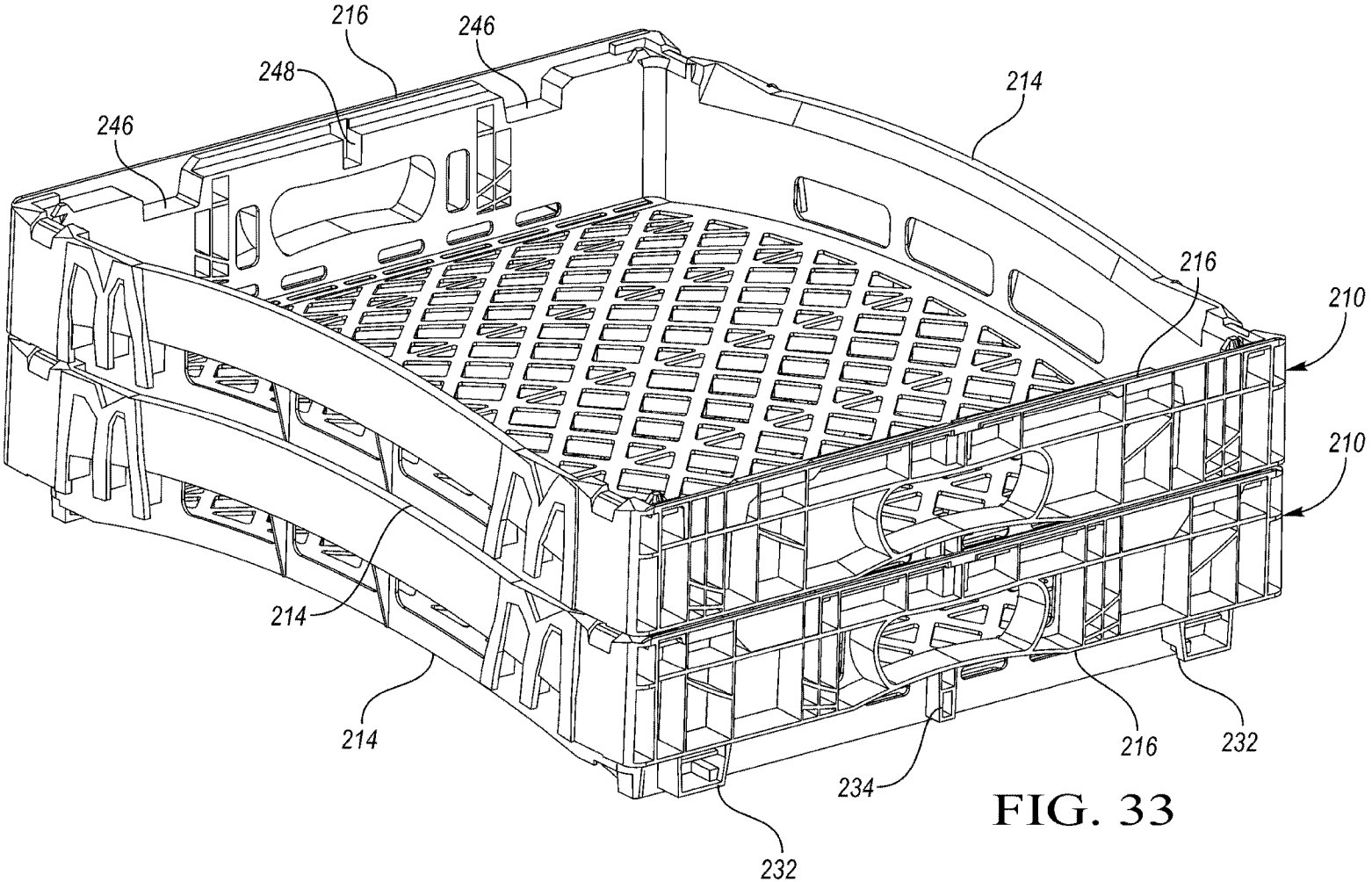
FIG. 33 illustrates a perspective view of the tray of FIG. 27 in a low stacked position on a similar tray.
Figure 34:
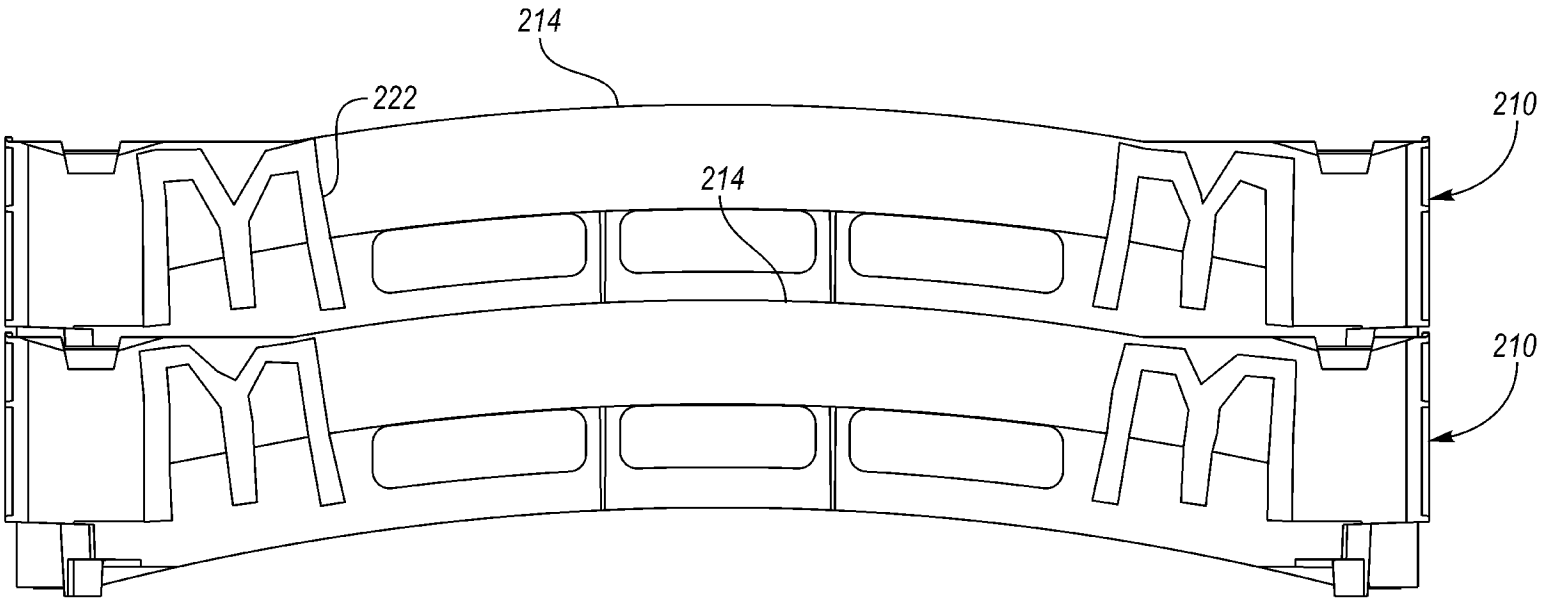
FIG. 34 illustrates a front view of the tray of FIG. 27 in the low stacked position on the similar tray.
Figure 35:
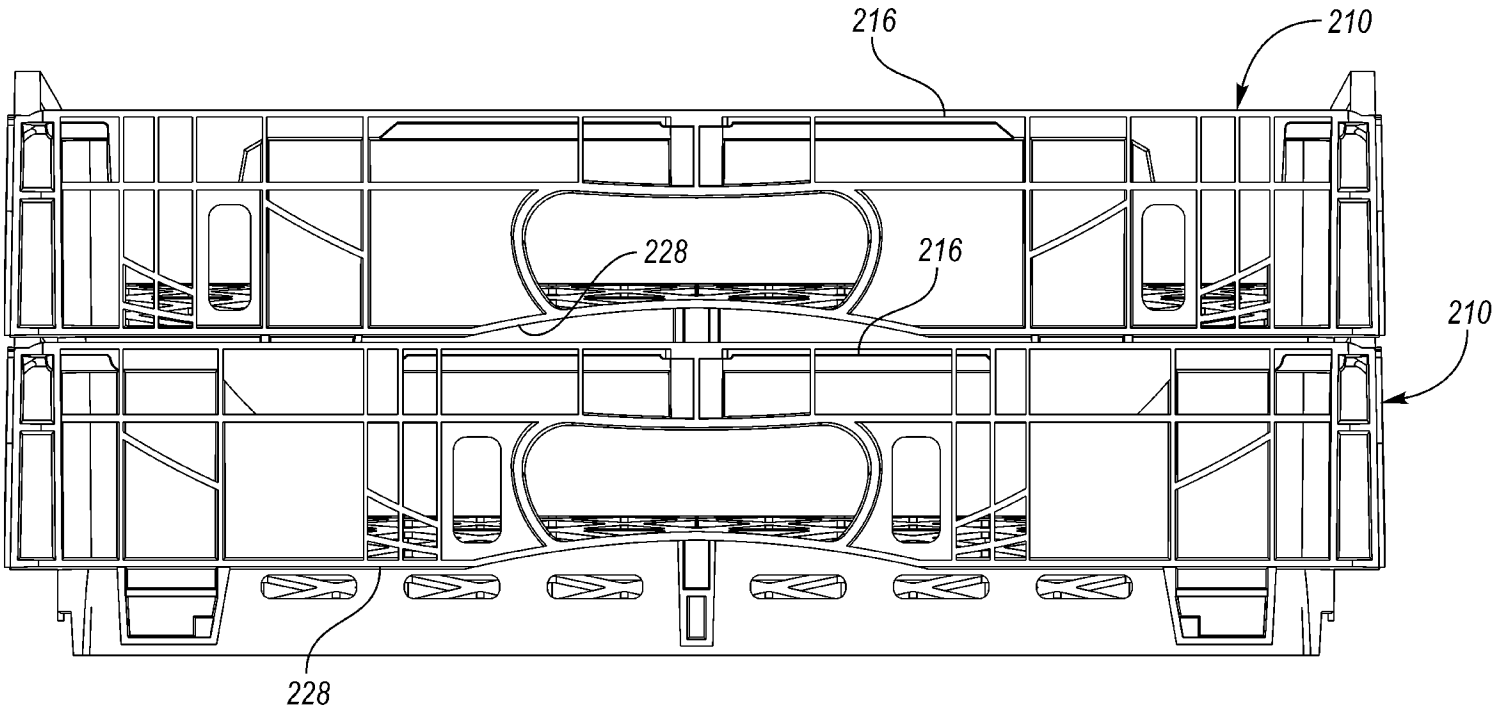
FIG. 35 illustrates an end view of the tray of FIG. 27 in the low stacked position on the similar tray.

FIG. 33 shows the trays 210 stacked in a low stacking height configuration. In this configuration, the upper tray 210 is oriented 180 degrees relative to the lower tray so that the feet can be received in the pockets. In this orientation, the upper tray 210 stacks lower on the lower tray 210, so that the overall stacking height is reduced. More trays 210 would be stacked on the upper tray 210 the same way. FIG. 34 is a front view of the trays 210 of FIG. 33. FIG. 35 is a side view of the trays 210 of FIG. 33.

Figure 36:
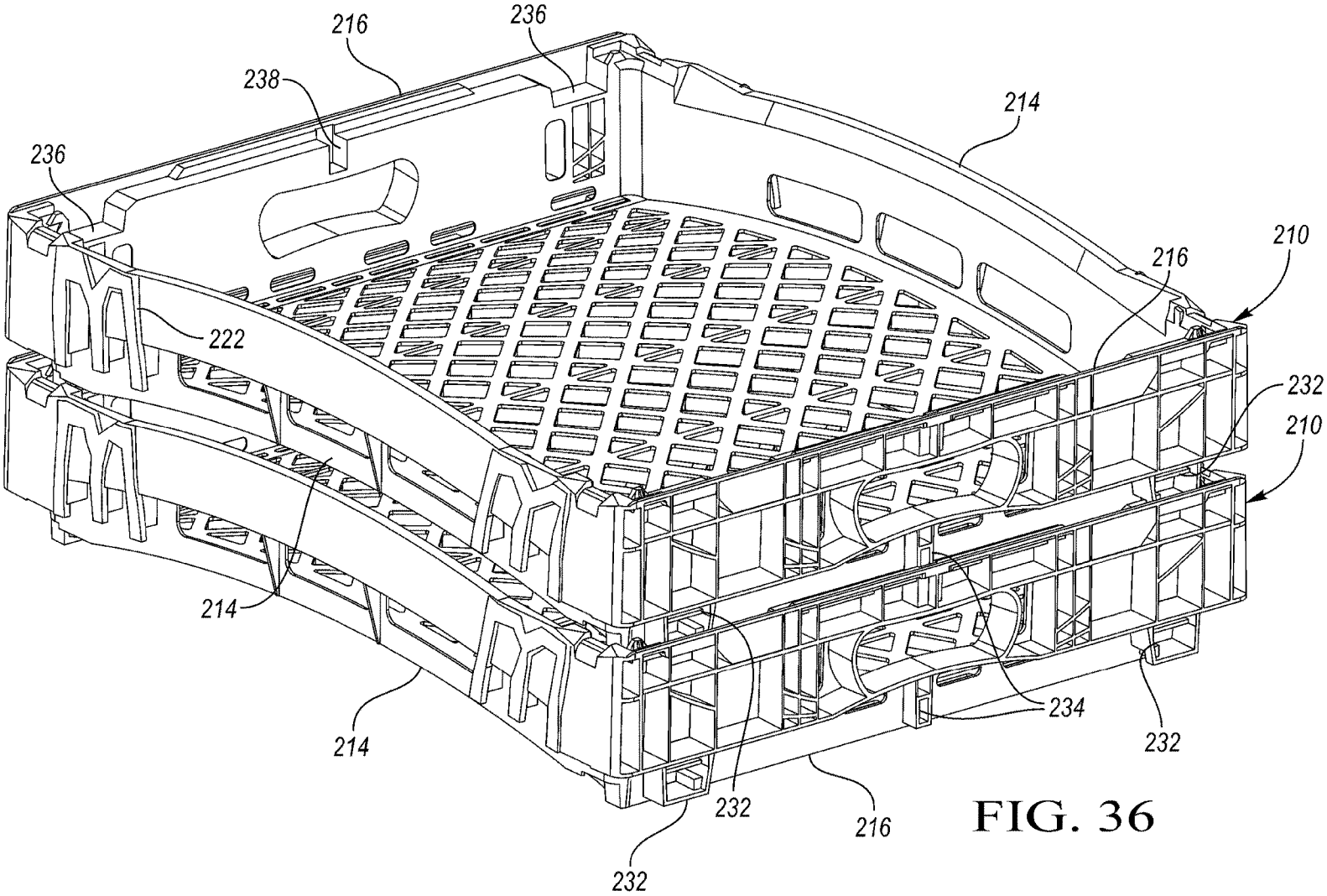
FIG. 36 illustrates a top perspective view of the tray of FIG. 27 in a high stacked position on the similar tray.
Figure 37:
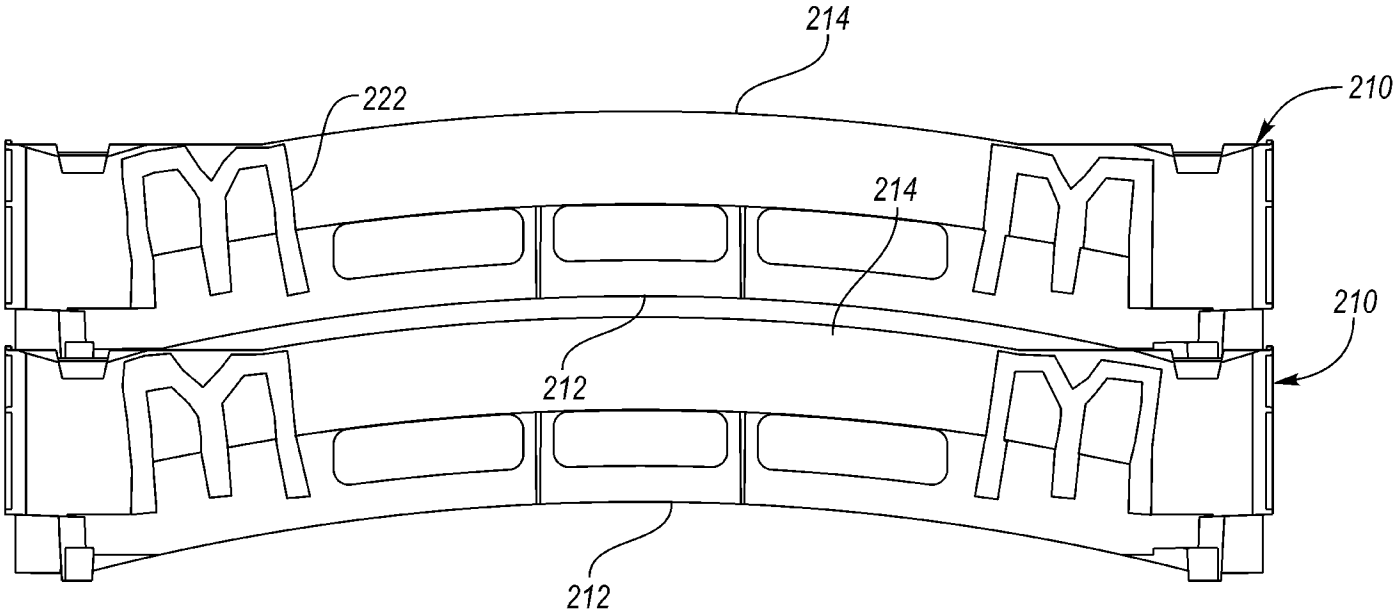
FIG. 37 illustrates a front view of the tray of FIG. 27 stacked in the high stacked position on the similar tray.

In FIGS. 36-37, the trays 210 are in the high stacking height configuration. The upper tray 210 is oriented the same way as the lower tray 210 so that the feet are not received in the pockets and the upper tray 210 therefore stacks higher. This arrangement of stacking feet in bakery trays is well-known as are other configurations that provide multiple stacking heights, any of which could be used with the present invention. For example, the pockets may be arranged so that orienting the trays 210 the same way will provide the low stack position. Alternatively, the tray 210 could have a single stacking height, such that the trays 210 would stack at the same height in either orientation.

In any of the stacked positions, because the base 212 of the upper tray 210 has the same contour as the base 212 of the lower tray 210, the vertical height permitted for the product in the tray 210 is maintained. The curvature of the base 212 increases the area of the base 212 so that more product can be accommodated without increasing the outer footprint of the tray 210.

The curved base 212 is designed to increase the footprint of the tray's 210 internal dimensions without increasing the external footprint. This allows the user to fit product in each tray 210 with adequate clearance while maximizing area packout efficiency. The profile of the base 212 could alternatively consist of a single or any combination of curves, angles, steps, etc. geometry as necessary to suit the product going into the tray 210. While the profiling is intended to increase the internal footprint surface area, using like-profiled trays 210 in a stacked configuration maintains internal product height clearance.

In addition to the internal footprint, the profiled base 212 may also provide a structural benefit to the tray 210. The structural benefit would provide decreased tray flexure and/or bowing which may cause product damage, internal fitment issues, or external fitment issues.

Like the base 212, the walls 214 can be profiled to accommodate product and clearance without increasing the external footprint. The wall 214 profile could consist of a single or any combination of curves, angles, steps, etc. geometry as necessary to suit the product going into the tray 210. The wall profiling allows use of the multiple height positions and stacking configurations.

Figure 38:
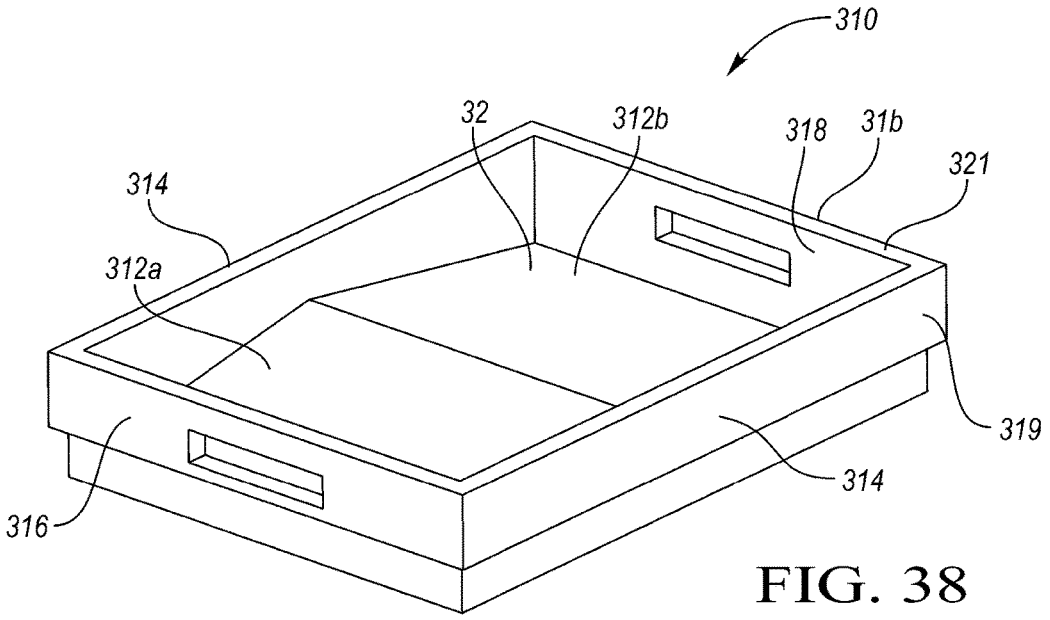
FIG. 38 illustrates an example tray according to a fourth embodiment.

FIG. 38 illustrates a tray 310 according to a fourth embodiment. The tray 310 includes a base 312, a pair front and rear walls 314, and a pair of side walls 316. The base 312 includes a first half 312*a* and a second half 312*b* that slants upward from the sidewalls 316 to peak at a middle portion of the front and rear walls 314.

Each of the front and rear walls 314 and the pair of side walls 316 include an inner wall portion 318 and an outer wall portion 319 (or lip). The outer wall portion 319 is spaced outward of the inner wall portion 318 and extends downward from an upper wall portion 321 but not all the way to the bottom of the tray 310. In the illustrated non-limiting embodiment, the outer wall portion 319 extends about halfway from the upper edge of the tray 310 toward the bottom of the tray 310.

Figure 39:
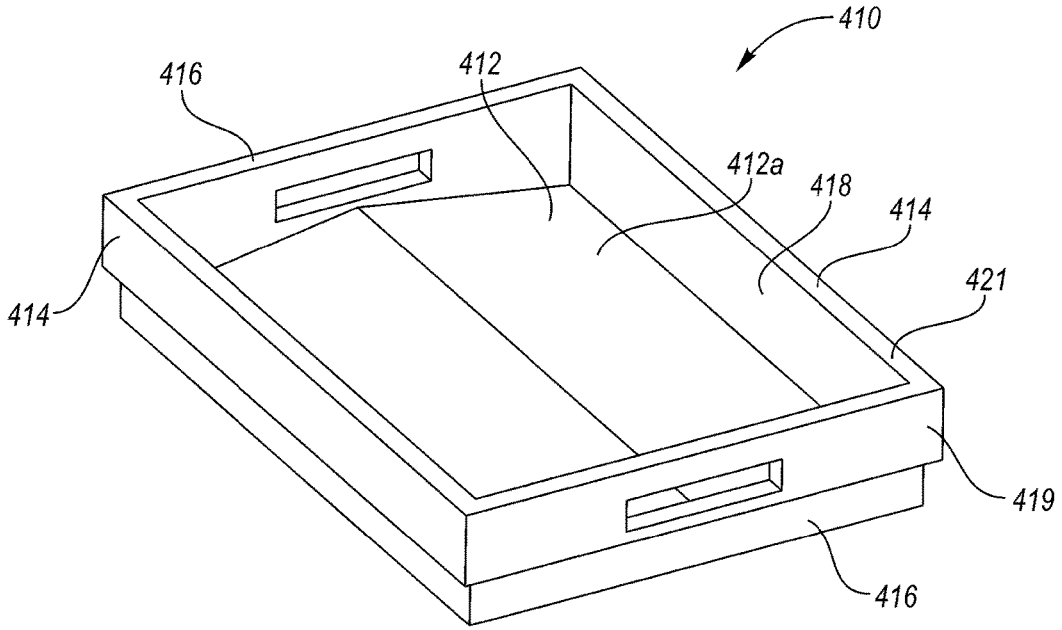
FIG. 39 illustrates an example tray according to a fifth embodiment.

FIG. 39 illustrates a tray 410 according to a fifth embodiment. The tray 410 includes a base 412, a pair front and rear walls 414, and a pair of side walls 416. The base 412 includes a first half 412*a* and a second half 412*b* that slants upward from the front and rear walls 414 to peak at a middle portion of the sidewalls 416.

Each of the front and rear walls 314 and the pair of side walls 316 include an inner wall portion 318 and an outer wall portion 319 (or lip). The outer wall portion 319 is spaced outward of the inner wall portion 318 and extends downward from an upper wall portion 321 but not all the way to the bottom of the tray 310. In the illustrated non-limiting embodiment, the outer wall portion 319 extends about halfway from the upper edge of the tray 310 toward the bottom of the tray 310.

Although the different non-limiting embodiments are illustrated as having specific components, the embodiments of this disclosure are not limited to those particular combinations. It is possible to use some of the components or features from any of the non-limiting embodiments in combination with features or components from any of the other non-limiting embodiments.

It should be understood that like reference numerals identify corresponding or similar elements throughout the several drawings. It should also be understood that although a particular component arrangement is disclosed and illustrated in these non-limiting embodiments, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A tray comprising:

a base having a curved profile;

a first pair of walls extending upward from the base; and a second pair of walls extending upward from the base, wherein the curved profile of the base extends upward from each of the first pair of walls and peaks along a middle portion of the second pair of walls, the curved profile of the base includes one continuous curve extending from one of the first pair of walls to another one of the first pair of walls, and the second pair of walls each include a curved profile that curves in the same direction as the curved profile of the base and an inner wall portion spaced from an outer wall portion by an upper wall portion.

2. The tray of claim 1, wherein the second pair of walls include the inner wall portion spaced from the outer wall portion by at least one gusset.

3. The tray of claim 1, wherein the curved profile of the second pair of walls includes a peak at a middle portion of the second pair of walls.

4. The tray of claim 3, wherein the second pair of walls includes include the inner wall portion spaced from the outer wall portion by at least one gusset.

5. The tray of claim 1, wherein base includes a support surface and a plurality of ribs extending downward from the support surface and a plurality of openings formed through the support surface between the ribs to form a grid.

6. The tray of claim 1, wherein the first pair of walls include a plurality of ribs on an outer surface.

7. The tray of claim 1, wherein the curved profile of the second pair of walls is identical to at least a portion of the curved profile of the base.

8. A tray comprising:

a base including a plurality of ribs extending downward from a support surface, a plurality of openings formed through the support surface between the ribs to form a grid;

a first pair of opposed walls extending upward from the base; and a second pair of opposed walls extending upward from the base, wherein the base extends upward from each of the first pair of walls and peaks along a middle portion of the second pair of walls, the second pair of walls each include a lowermost edge that is curved upward toward the middle portion of the second pair of walls and curves in the same direction as the curved profile of the base wherein the second pair of walls each include an uppermost edge that is curved upward toward the middle portion of the second pair of walls wherein the second pair of walls each include an inner wall portion spaced from an outer wall portion by an upper wall portion, wherein the inner wall portion includes the lowermost edge and wherein the upper wall portion forms the uppermost edge.

9. The tray of claim 8, wherein the base extends along one continuous curve extending from one of the first pair of walls to another one of the first pair of walls.

10. The tray of claim 8, wherein the outer wall portion of each of the second pair of walls includes a lowermost edge that is curved upward toward the middle portion of the second pair of walls.

11. The tray of claim 10, wherein the first pair of walls include a plurality of ribs on an outer surface.

12. The tray of claim 8 wherein the first pair of walls each include a plurality of feet configured to provide low stacking height when stacked on an identical tray in a first orientation and to provide a high stacking height when the tray is rotated 180 degrees relative to first orientation.

13. A tray comprising:

a convex base including a plurality of ribs extending downward from a support surface, a plurality of openings formed through the support surface between the ribs to form a grid;

a first pair of opposed walls extending upward from the base, wherein the first pair of walls each include a plurality of feet configured to provide low stacking height when stacked on an identical tray in a first orientation and to provide a high stacking height when the tray is rotated 180 degrees relative to first orientation; and a second pair of opposed walls extending upward from the base, wherein the second pair of walls each include a lowermost edge that is curved upward toward a middle portion of the second pair of walls to follow a curve of the base and the second pair of walls each include an uppermost edge that is curved upward toward the middle portion of the second pair of walls and the second pair of walls each include an inner wall portion spaced from an outer wall portion by an upper wall portion, wherein the inner wall portion includes the lowermost edge and wherein the upper wall portion forms the uppermost edge, wherein the outer wall portion of each of the second pair of walls includes a lowermost edge that is curved upward toward the middle portion of the second pair of walls.

14. The tray of claim 13, wherein the first pair of walls each include a plurality of ribs on an outer surface.

* * * * *